US008262460B2

(12) United States Patent
Mattice et al.

(10) Patent No.: US 8,262,460 B2
(45) Date of Patent: Sep. 11, 2012

(54) GAMING DEVICE AND METHOD HAVING PURCHASABLE RANDOMLY SELECTED PAYTABLES

(75) Inventors: Harold E. Mattice, Gardnerville, NV (US); Christian E. Gadda, Las Vegas, NV (US); James W. Stockdale, Clio, CA (US); Chan W. Griswold, Reno, NV (US); Richard Wilder, Sparks, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/181,181

(22) Filed: Jul. 12, 2011

(65) Prior Publication Data

US 2011/0269537 A1 Nov. 3, 2011

Related U.S. Application Data

(62) Division of application No. 11/469,584, filed on Sep. 1, 2006, now Pat. No. 8,002,621.

(51) Int. Cl.
*A63F 9/24* (2006.01)

(52) U.S. Cl. ..... 463/21

(58) Field of Classification Search ..... 463/16, 463/20, 21

See application file for complete search history.

(56) References Cited

U.S. PATENT DOCUMENTS

| | | | |
|---|---|---|---|
| 3,628,259 | A | 12/1971 | Kahn |
| 4,156,976 | A | 6/1979 | Mikun |
| 4,621,814 | A | 11/1986 | Stepan et al. |
| 4,624,459 | A | 11/1986 | Kaufman |
| 4,669,731 | A | 6/1987 | Clarke |
| 4,695,053 | A | 9/1987 | Vazquez, Jr. et al. |
| 4,743,022 | A | 5/1988 | Wood |
| 4,805,907 | A | 2/1989 | Hagiwara |
| 4,838,552 | A | 6/1989 | Hagiwara |
| 4,856,787 | A | 8/1989 | Itkis |

(Continued)

FOREIGN PATENT DOCUMENTS

| | | |
|---|---|---|
| AU | 771847 | 3/2001 |

(Continued)

OTHER PUBLICATIONS

Letter from Marvin A. Motsenbocker of Mots Law dated Jan. 3, 2012 regarding Third Party Submission in Published Application Under 37 C.F.R. 1.99 filed for U.S. Appl. No. 13/181,198 (1 page).

(Continued)

*Primary Examiner* — Corbett B Coburn

(74) *Attorney, Agent, or Firm* — Neal, Gerber & Eisenberg LLP

(57) ABSTRACT

An apparatus and method for a game including a plurality of paytables, wherein each of the paytables has an average expected payout. The gaming device initially employs a default paytable and enables a player to cause the gaming device to change the employed paytable. If the player chooses to cause the gaming device to change the employed paytable, the gaming device randomly selects another paytable from the plurality of paytables and determines a game outcome based on the randomly selected paytable. If the player does not choose to cause the gaming device to change the employed paytable, the gaming device determines a game outcome based on the default paytable. In one embodiment, when a player chooses to cause the gaming device to select another paytable, the player has a chance to obtain a paytable that includes higher or better awards.

17 Claims, 14 Drawing Sheets

U.S. PATENT DOCUMENTS

| | | | | |
|---|---|---|---|---|
| 4,991,848 | A | | 2/1991 | Greenwood et al. |
| 5,011,159 | A | | 4/1991 | Fortunato et al. |
| 5,019,973 | A | | 5/1991 | Wilcox et al. |
| 5,088,737 | A | | 2/1992 | Frank et al. |
| 5,116,055 | A | | 5/1992 | Tracy |
| 5,123,649 | A | | 6/1992 | Tiberio |
| 5,167,413 | A | | 12/1992 | Fulton |
| 5,224,706 | A | | 7/1993 | Bridgeman et al. |
| 5,248,142 | A | | 9/1993 | Breeding |
| 5,294,120 | A | | 3/1994 | Schultz |
| 5,294,128 | A | | 3/1994 | Marquez |
| 5,342,047 | A | | 8/1994 | Heidel et al. |
| 5,344,144 | A | | 9/1994 | Canon |
| 5,356,140 | A | | 10/1994 | Dabrowski et al. |
| 5,375,830 | A | | 12/1994 | Takemoto et al. |
| 5,377,973 | A | | 1/1995 | Jones et al. |
| 5,393,067 | A | | 2/1995 | Paulsen et al. |
| 5,397,125 | A | | 3/1995 | Adams |
| 5,401,023 | A | | 3/1995 | Wood |
| 5,415,404 | A | | 5/1995 | Joshi et al. |
| 5,489,101 | A | | 2/1996 | Moody |
| 5,511,781 | A | | 4/1996 | Wood et al. |
| 5,531,448 | A | | 7/1996 | Moody |
| 5,542,669 | A | * | 8/1996 | Charron et al. ..... 463/13 |
| 5,570,885 | A | | 11/1996 | Ornstein |
| 5,580,055 | A | | 12/1996 | Hagiwara |
| 5,584,486 | A | | 12/1996 | Franklin |
| 5,584,764 | A | | 12/1996 | Inoue |
| 5,593,161 | A | | 1/1997 | Boylan et al. |
| 5,611,535 | A | | 3/1997 | Tiberio |
| 5,645,485 | A | | 7/1997 | Clapper, Jr. |
| 5,657,993 | A | | 8/1997 | Merlino et al. |
| 5,678,001 | A | | 10/1997 | Nagel et al. |
| 5,707,285 | A | | 1/1998 | Place et al. |
| 5,711,715 | A | | 1/1998 | Ringo et al. |
| 5,718,431 | A | | 2/1998 | Ornstein |
| 5,720,662 | A | | 2/1998 | Holmes, Jr. et al. |
| 5,722,891 | A | | 3/1998 | Inoue |
| 5,732,950 | A | | 3/1998 | Moody |
| 5,766,074 | A | | 6/1998 | Cannon et al. |
| 5,769,716 | A | | 6/1998 | Saffari et al. |
| 5,772,509 | A | | 6/1998 | Weiss |
| 5,775,692 | A | | 7/1998 | Watts et al. |
| 5,788,573 | A | | 8/1998 | Baerlocher et al. |
| 5,788,574 | A | | 8/1998 | Ornstein et al. |
| 5,791,987 | A | | 8/1998 | Chen et al. |
| 5,806,855 | A | | 9/1998 | Cherry |
| 5,807,172 | A | | 9/1998 | Piechowiak |
| 5,816,916 | A | | 10/1998 | Moody |
| 5,816,918 | A | | 10/1998 | Kelly et al. |
| 5,817,172 | A | | 10/1998 | Yamada et al. |
| 5,823,873 | A | | 10/1998 | Moody |
| 5,823,874 | A | | 10/1998 | Adams |
| 5,839,730 | A | | 11/1998 | Pike |
| 5,848,932 | A | | 12/1998 | Adams |
| 5,868,619 | A | | 2/1999 | Wood et al. |
| 5,882,105 | A | | 3/1999 | Barlow |
| 5,882,258 | A | | 3/1999 | Kelly et al. |
| 5,902,184 | A | | 5/1999 | Bennett |
| 5,910,048 | A | | 6/1999 | Feinberg |
| 5,911,418 | A | | 6/1999 | Adams |
| 5,934,672 | A | | 8/1999 | Sines et al. |
| 5,947,820 | A | | 9/1999 | Morro et al. |
| 5,951,397 | A | | 9/1999 | Dickinson |
| 5,954,335 | A | | 9/1999 | Moody |
| 5,967,893 | A | | 10/1999 | Lawrence et al. |
| 5,976,016 | A | | 11/1999 | Moody et al. |
| 5,980,384 | A | | 11/1999 | Barrie |
| 5,984,310 | A | | 11/1999 | English |
| 5,984,781 | A | | 11/1999 | Sunaga |
| 5,993,316 | A | | 11/1999 | Coyle et al. |
| 5,997,401 | A | | 12/1999 | Crawford |
| 6,004,207 | A | | 12/1999 | Wilson, Jr. et al. |
| 6,007,066 | A | | 12/1999 | Moody |
| 6,007,424 | A | | 12/1999 | Evers et al. |
| 6,012,720 | A | | 1/2000 | Webb |
| 6,012,981 | A | | 1/2000 | Fujioka et al. |
| 6,012,983 | A | | 1/2000 | Walker et al. |
| 6,032,955 | A | | 3/2000 | Luciano et al. |
| 6,056,642 | A | | 5/2000 | Bennett |
| 6,062,980 | A | | 5/2000 | Luciano |
| 6,062,981 | A | | 5/2000 | Luciano, Jr. |
| 6,071,192 | A | | 6/2000 | Weiss |
| 6,077,163 | A | | 6/2000 | Walker et al. |
| 6,089,977 | A | | 7/2000 | Bennett |
| 6,089,978 | A | | 7/2000 | Adams |
| 6,089,980 | A | | 7/2000 | Gauselmann |
| 6,093,102 | A | | 7/2000 | Bennett |
| 6,098,985 | A | | 8/2000 | Moody |
| 6,102,400 | A | | 8/2000 | Scott et al. |
| 6,102,402 | A | | 8/2000 | Scott et al. |
| 6,105,962 | A | | 8/2000 | Malavazos et al. |
| 6,110,041 | A | | 8/2000 | Walker et al. |
| 6,113,098 | A | | 9/2000 | Adams |
| 6,120,378 | A | | 9/2000 | Moody et al. |
| 6,126,165 | A | | 10/2000 | Sakamoto |
| 6,126,541 | A | | 10/2000 | Fuchs |
| 6,126,542 | A | | 10/2000 | Fier |
| 6,129,632 | A | | 10/2000 | Luciano |
| 6,132,311 | A | | 10/2000 | Williams |
| 6,135,884 | A | | 10/2000 | Hedrick et al. |
| 6,142,872 | A | | 11/2000 | Walker et al. |
| 6,142,874 | A | | 11/2000 | Kodachi et al. |
| 6,149,521 | A | | 11/2000 | Sanduski |
| 6,155,925 | A | | 12/2000 | Giobbi et al. |
| 6,158,741 | A | | 12/2000 | Koelling |
| 6,159,095 | A | | 12/2000 | Frohm et al. |
| 6,159,097 | A | | 12/2000 | Gura |
| 6,159,098 | A | | 12/2000 | Slomiany et al. |
| 6,162,121 | A | | 12/2000 | Morro et al. |
| 6,168,520 | B1 | | 1/2001 | Baerlocher et al. |
| 6,168,522 | B1 | | 1/2001 | Walker et al. |
| 6,168,523 | B1 | | 1/2001 | Piechowiak et al. |
| 6,174,233 | B1 | | 1/2001 | Sunaga et al. |
| 6,174,235 | B1 | | 1/2001 | Walker et al. |
| 6,179,711 | B1 | | 1/2001 | Yoseloff |
| 6,186,894 | B1 | | 2/2001 | Mayeroff |
| 6,190,255 | B1 | | 2/2001 | Thomas et al. |
| 6,193,606 | B1 | | 2/2001 | Walker et al. |
| 6,196,547 | B1 | | 3/2001 | Pascal et al. |
| 6,203,429 | B1 | | 3/2001 | Demar et al. |
| 6,210,277 | B1 | | 4/2001 | Stefan |
| 6,217,022 | B1 | | 4/2001 | Astaneha |
| 6,217,448 | B1 | | 4/2001 | Olsen |
| 6,224,482 | B1 | | 5/2001 | Bennett |
| 6,224,483 | B1 | | 5/2001 | Mayeroff |
| 6,224,484 | B1 | | 5/2001 | Okuda et al. |
| 6,227,969 | B1 | | 5/2001 | Yoseloff |
| 6,227,971 | B1 | | 5/2001 | Weiss |
| 6,231,442 | B1 | | 5/2001 | Mayeroff |
| 6,231,445 | B1 | | 5/2001 | Acres |
| 6,234,897 | B1 | | 5/2001 | Frohm et al. |
| 6,238,287 | B1 | | 5/2001 | Komori et al. |
| 6,244,957 | B1 | | 6/2001 | Walker et al. |
| 6,254,482 | B1 | | 7/2001 | Walker et al. |
| 6,270,409 | B1 | | 8/2001 | Shuster |
| 6,290,603 | B1 | | 9/2001 | Luciano, Jr. |
| 6,299,165 | B1 | | 10/2001 | Nagano |
| 6,302,790 | B1 | | 10/2001 | Brossard |
| 6,302,791 | B1 | | 10/2001 | Frohm et al. |
| 6,309,299 | B1 | | 10/2001 | Weiss |
| 6,312,331 | B1 | | 11/2001 | Tamaki |
| 6,312,334 | B1 | | 11/2001 | Yoseloff |
| 6,315,662 | B1 | | 11/2001 | Jorasch et al. |
| 6,336,862 | B1 | | 1/2002 | Byrne |
| 6,358,147 | B1 | | 3/2002 | Jaffe et al. |
| 6,368,214 | B1 | | 4/2002 | Luciano |
| 6,375,569 | B1 | | 4/2002 | Acres |
| 6,375,570 | B1 | | 4/2002 | Poole |
| 6,394,902 | B1 | | 5/2002 | Glavich et al. |
| 6,398,218 | B1 | | 6/2002 | Vancura |
| 6,413,163 | B1 | | 7/2002 | Yamauchi et al. |
| 6,419,578 | B1 | | 7/2002 | Moody et al. |
| 6,425,823 | B1 | | 7/2002 | Byrne |
| 6,428,412 | B1 | | 8/2002 | Anderson et al. |
| 6,435,968 | B1 | | 8/2002 | Torango |
| 6,439,995 | B1 | | 8/2002 | Hughs-Baird et al. |

| | | | |
|---|---|---|---|
| 6,443,456 | B1 | 9/2002 | Gajor |
| 6,450,884 | B1 | 9/2002 | Seelig et al. |
| 6,468,156 | B1 | 10/2002 | Hughs-Baird et al. |
| 6,491,584 | B2 | 12/2002 | Graham et al. |
| 6,517,073 | B1 | 2/2003 | Vancura |
| 6,569,013 | B1 | 5/2003 | Taylor |
| 6,589,115 | B2 | 7/2003 | Walker et al. |
| 6,599,193 | B2 | 7/2003 | Baerlocher et al. |
| 6,607,195 | B2 | 8/2003 | Vancura |
| 6,609,969 | B1 | 8/2003 | Luciano et al. |
| 6,609,970 | B1 | 8/2003 | Juciano, Jr. |
| 6,612,927 | B1 | 9/2003 | Slomiany et al. |
| 6,634,942 | B2 | 10/2003 | Walker et al. |
| 6,634,945 | B2 | 10/2003 | Glavich et al. |
| 6,663,487 | B1 | 12/2003 | Ladner |
| 6,682,073 | B2 | 1/2004 | Bryant et al. |
| 6,695,696 | B1 | 2/2004 | Kaminkow |
| 6,702,289 | B1 | 3/2004 | Feola |
| 6,702,675 | B2 | 3/2004 | Poole et al. |
| 6,712,693 | B1 | 3/2004 | Hettinger |
| 6,712,695 | B2 | 3/2004 | Mothwurf et al. |
| 6,726,563 | B1 | 4/2004 | Baerlocher et al. |
| 6,739,970 | B2 | 5/2004 | Luciano |
| 6,746,016 | B2 | 6/2004 | Perrie et al. |
| 6,758,749 | B2 | 7/2004 | Krintzman |
| 6,764,396 | B2 | 7/2004 | Seelig et al. |
| 6,786,824 | B2 | 9/2004 | Cannon |
| 6,802,778 | B1 | 10/2004 | Lemay et al. |
| 6,857,957 | B2 | 2/2005 | Marks et al. |
| 6,884,167 | B2 | 4/2005 | Walker et al. |
| 6,923,720 | B2 | 8/2005 | Loose |
| 6,960,133 | B1 | 11/2005 | Marks et al. |
| 7,001,274 | B2 | 2/2006 | Baerlocher et al. |
| 7,008,324 | B1 | 3/2006 | Johnson et al. |
| 7,014,560 | B2 | 3/2006 | Glavich et al. |
| 7,029,395 | B1 | 4/2006 | Baerlocher |
| 7,052,395 | B2 | 5/2006 | Glavich et al. |
| 7,121,943 | B2 | 10/2006 | Webb et al. |
| 7,198,569 | B2 | 4/2007 | Wolf et al. |
| 7,291,068 | B2 | 11/2007 | Bryant et al. |
| 7,318,774 | B2 | 1/2008 | Bryant et al. |
| 7,329,179 | B2 | 2/2008 | Baerlocher |
| 7,357,714 | B2 | 4/2008 | Tessmer et al. |
| 7,419,429 | B2 | 9/2008 | Taylor |
| 2001/0018361 | A1 | 8/2001 | Acres |
| 2001/0038178 | A1 | 11/2001 | Vancura |
| 2001/0054794 | A1 | 12/2001 | Cole et al. |
| 2002/0086725 | A1 | 7/2002 | Fasbender et al. |
| 2002/0137559 | A1 | 9/2002 | Baerlocher |
| 2002/0165023 | A1 | 11/2002 | Brosnan et al. |
| 2002/0187827 | A1 | 12/2002 | Blankstein |
| 2002/0193158 | A1 | 12/2002 | Weiss et al. |
| 2003/0027623 | A1 | 2/2003 | Rose |
| 2003/0054873 | A1 | 3/2003 | Peterson |
| 2003/0060266 | A1 | 3/2003 | Baerlocher |
| 2003/0060269 | A1 | 3/2003 | Paulsen et al. |
| 2003/0060281 | A1 | 3/2003 | Vancura |
| 2003/0069063 | A1 | 4/2003 | Bilyeu et al. |
| 2003/0092480 | A1 | 5/2003 | White et al. |
| 2003/0092490 | A1 | 5/2003 | Gauselmann |
| 2003/0153383 | A1 | 8/2003 | Baerlocher et al. |
| 2003/0195031 | A1 | 10/2003 | O'Donovan et al. |
| 2003/0207713 | A1 | 11/2003 | Taylor |
| 2003/0216165 | A1 | 11/2003 | Singer et al. |
| 2004/0017043 | A1 | 1/2004 | Moody |
| 2004/0023713 | A1 | 2/2004 | Wolf et al. |
| 2004/0038724 | A1 | 2/2004 | Asdale |
| 2004/0048650 | A1 | 3/2004 | Mierau et al. |
| 2004/0162129 | A1 | 8/2004 | Nelson |
| 2004/0219969 | A1 | 11/2004 | Casey et al. |
| 2004/0242313 | A1 | 12/2004 | Munoz |
| 2004/0242315 | A1 | 12/2004 | Paulsen et al. |
| 2004/0254011 | A1 | 12/2004 | Muskin |
| 2005/0009597 | A1 | 1/2005 | Daly |
| 2005/0029745 | A1 | 2/2005 | Walker et al. |
| 2005/0037838 | A1 | 2/2005 | Dunaevsky et al. |
| 2005/0054429 | A1 | 3/2005 | Baerlocher et al. |
| 2005/0059481 | A1 | 3/2005 | Joshi et al. |
| 2005/0060050 | A1 | 3/2005 | Baerlocher |
| 2005/0071023 | A1 | 3/2005 | Gilliland et al. |
| 2005/0079911 | A1 | 4/2005 | Nakatsu |
| 2005/0090306 | A1 | 4/2005 | Seelig et al. |
| 2005/0096123 | A1 | 5/2005 | Cregan et al. |
| 2005/0130737 | A1 | 6/2005 | Englman et al. |
| 2005/0176494 | A1 | 8/2005 | Thomas |
| 2005/0202863 | A1 | 9/2005 | Macaulay |
| 2005/0208992 | A1 | 9/2005 | Randall |
| 2005/0215311 | A1 | 9/2005 | Hornik et al. |
| 2005/0218590 | A1 | 10/2005 | O'Halloran et al. |
| 2005/0233803 | A1 | 10/2005 | Yang |
| 2005/0282615 | A1 | 12/2005 | Englman et al. |
| 2005/0282625 | A1 | 12/2005 | Nicely |
| 2005/0282629 | A1 | 12/2005 | Gagner |
| 2005/0285337 | A1 | 12/2005 | Durham et al. |
| 2006/0003834 | A1 | 1/2006 | Okada |
| 2006/0009283 | A1 | 1/2006 | Englman et al. |
| 2006/0009286 | A1 | 1/2006 | Durham et al. |
| 2006/0014580 | A1 | 1/2006 | Hawthorn |
| 2003/0025211 | A1 | 2/2006 | Wilday et al. |
| 2006/0025193 | A1 | 2/2006 | Gail et al. |
| 2006/0025211 | A1 | 2/2006 | Wilday et al. |
| 2006/0040728 | A1 | 2/2006 | Fuller |
| 2006/0046816 | A1 | 3/2006 | Walker et al. |
| 2006/0058095 | A1 | 3/2006 | Berman et al. |
| 2006/0063580 | A1 | 3/2006 | Nguyen et al. |
| 2006/0069619 | A1 | 3/2006 | Walker et al. |
| 2006/0073873 | A1 | 4/2006 | Rodgers et al. |
| 2006/0073897 | A1 | 4/2006 | Englman et al. |
| 2006/0094495 | A1 | 5/2006 | Gelber et al. |
| 2006/0121971 | A1 | 6/2006 | Slomiany et al. |
| 2006/0142077 | A1 | 6/2006 | Miles et al. |
| 2006/0205480 | A1 | 9/2006 | Glavich et al. |
| 2006/0252515 | A1 | 11/2006 | Walker et al. |
| 2006/0287034 | A1 | 12/2006 | Englman et al. |
| 2007/0021182 | A1 | 1/2007 | Gauselmann |
| 2007/0060292 | A1 | 3/2007 | Peterson |
| 2007/0087804 | A1 | 4/2007 | Knowles et al. |
| 2007/0135207 | A1 | 6/2007 | Tarantino |
| 2007/0287532 | A1 | 12/2007 | Jackson |
| 2008/0214292 | A1 | 9/2008 | Bryant et al. |

FOREIGN PATENT DOCUMENTS

| | | | |
|---|---|---|---|
| AU | 200245837 | | 12/2002 |
| DE | 3105266 | | 9/1982 |
| EP | 0 558307 | A2 | 2/1993 |
| EP | 753 331 | A2 | 1/1997 |
| EP | 874 337 | A1 | 10/1998 |
| EP | 945 837 | A2 | 9/1999 |
| EP | 0 981 119 | A2 | 2/2000 |
| EP | 0 984 407 | A2 | 3/2000 |
| EP | 989 531 | A2 | 3/2000 |
| EP | 1 076 321 | A1 | 2/2001 |
| EP | 1 195 730 | A2 | 4/2002 |
| EP | 1 513 116 | A2 | 9/2004 |
| EP | 1 589 501 | A1 | 11/2004 |
| EP | 1 536 388 | A1 | 1/2005 |
| EP | 1 580 701 | A2 | 3/2005 |
| EP | 1513114 | A3 | 6/2005 |
| GB | 970806 | | 9/1964 |
| GB | 2 137 392 | A | 10/1984 |
| GB | 2292245 | | 2/1996 |
| GB | 2 322 217 | A | 8/1998 |
| GB | 2382911 | | 6/2003 |
| GB | 2 387 950 | A | 10/2003 |
| JP | 09-164238 | A | 6/1997 |
| JP | 2003-062175 | A | 3/2003 |
| JP | 2003-325760 | A | 11/2003 |
| WO | WO 8500910 | | 2/1985 |
| WO | WO 9800207 | | 1/1998 |
| WO | WO 9903078 | | 1/1999 |
| WO | WO 9945837 | | 9/1999 |
| WO | WO 02078804 | A1 | 10/2002 |
| WO | WO 03/026757 | A1 | 4/2003 |
| WO | WO 2005010831 | | 2/2005 |
| WO | WO 2005077480 | | 8/2005 |
| WO | WO 2005083599 | A1 | 9/2005 |
| WO | WO 2006002241 | | 1/2006 |
| WO | WO 2006004831 | | 1/2006 |

| | | |
|---|---|---|
| WO | WO 2006015442 A1 | 2/2006 |
| WO | WO 20061017431 | 2/2006 |
| WO | WO 2007090270 | 8/2007 |

OTHER PUBLICATIONS

Third Party Submission in Published Application Under 37 C.F.R. 1.99 filed for U.S. Appl. No. 13/181,198, dated Jan. 3, 2012 (3 pages).
JP 09-164238A and English translation of paragraph [0009] of same submitted with Third Party Submission in Published Application Under 37 C.F.R. 1.99 for U.S. Appl. No. 13/181,198 (3 pages).
JP 2003-325760A and English translation of paragraph [0025] of same submitted with Third Party Submission in Published Application Under 37 C.F.R. 1.99 for U.S. Appl. No. 13/181,198 (3 pages).
JP 2003-062175A and English translation of paragraph [0043] of same submitted with Third Party Submission in Published Application Under 37 C.F.R. 1.99 for U.S. Appl. No. 13/181,198 (3 pages).
"A Salute to Game Shows," The Price is Right—Pricing Games, printed from schuminweb.com/game-shows/shows/price-is-right/pricing-games.htm on Mar. 16, 2001.
3RV—Jackpot Party Advertisement written by WMS Gaming, Inc., published Aug. 8, 2002.
Big Time Red, White & Blue Advertisement written by IGT published 2005.
Bonus Games Advertisement written by IGT, published in 1999.
Bunco History and Rules, printed from http://world-bunco.com/history.html on May 22, 2000.
Creepy and Kooky written by Frank Legato, published by Strictly Slots in Jul. 2000, pp. 52-54.
Fey, Slot Machines, A Pictorial History of the First 100 Years, Liberty Belle Books, 1983, pp. 215, 219.
Jackpot Party Advertisement on website page http://www.wmsg~ing.com/products/slot/jpp/index.html, printed on Mar. 21, 2001, available prior to Sep. 1, 2006.
Jackpot Party Advertisements and Articles written by WMS Gaming, Inc., published Mar. 1998 (1 6 pages).
Jackpot Party Brochures and Articles written by WMS Gaming, Inc., published in 1998.
Jackpot Party Video 9-Line Advertisement written by WMS Gaming, Inc., available prior to Sep. 1, 2006.
Jeopardy Advertisements written by IGT, published in 2000.
Jeopardy Video Slots advertisement written by IGT, published in 2000.
Jeopardy, MegaJackpots Advertisement written by IGT, published in 1998.
Monopoly Blackjack Edition Game described in Mikohn brochure, published in 2000.
Multi-Action Blackjack brochure, http://conjelco.com/faq/bj.html from Apr. 25, 2001, printed on Jul. 30, 2001.
Multi-Play Poker by Bally Gaming, described in Strictly Slots, published in Dec. 2000.
Multi-Play Poker by Bally Gaming, printed from ballygaming.com/products/multi-play-poker.html on Apr. 25, 2001.
Play It Again Poker Brochure, written by IGT, published in 1999.
Power Slotto Brochure published by AC Coin & Slot prior to 2002 in or before December thereof.
Slots 2003 Article written by Melissa Raimondi, published in Jan. 2003.
Super Bonus Poker by Bally Gaming, described in Strictly Slots, published in Apr. 2000.
Super Times Pay Poker Advertisement, written by IGT, published in 2003.
Totem Pole Advertisement, written by IGT, published in 1997, in or before December thereof.
Turboreel by Barcrest, available prior to Sep. 1, 2006 (with English Translation).
We Make Gaming Funl Advertisement written by WMS Gaming Inc., available prior to Sep. 1, 2006.
Wheel of Madness Game, described in AC Coin & Slot brochure, published in 2000.

* cited by examiner

FIG. 3A

Paytable A

202a

| Winning Symbol Combination | Award |
|---|---|
| AAA | 250 |
| B B B | 1000 |
| C C C | 2000 |
| D D D | 10,000 |

204 224

214a

Average Expected Payback 98%

FIG. 3B

Paytable B

202b

| Winning Symbol Combination | Award |
|---|---|
| AAA | 1 |
| B B B | 500 |
| C C C | 3000 |
| D D D | 100,000 |

204 224

214b

Average Expected Payback 96%

FIG. 3C

Paytable C

202c

| Winning Symbol Combination | Award |
|---|---|
| AAA | 500 |
| B B B | 200 |
| C C C | 3000 |
| D D D | 5000 |

204 224

214c

Average Expected Payback 98%

Award Wheel A

Award Wheel B

Award Wheel C

GAMING DEVICE AND METHOD HAVING PURCHASABLE RANDOMLY SELECTED PAYTABLES

PRIORITY CLAIM

This application is a divisional of, and claims priority to and the benefit of, U.S. patent application Ser. No. 11/469,584, filed on Sep. 1, 2006, the contents of which are incorporated herein by reference in its entirety.

CROSS REFERENCE TO RELATED APPLICATIONS

This application relates to the following co-pending commonly owned patent applications: "GAMING DEVICE AND METHOD HAVING PURCHASABLE RANDOMLY SELECTED PAYTABLES," Ser. No. 13/181,166, and "GAMING DEVICE AND METHOD HAVING PURCHASABLE RANDOMLY SELECTED PAYTABLES," Ser. No. 13/181,198.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming device manufacturers strive to make wagering gaming devices that provide as much enjoyment, entertainment and excitement as possible for players. Providing interesting and exciting primary or base games and secondary or bonus games in which a player has an opportunity to win potentially large awards or credits is one way to enhance player enjoyment and excitement. Certain known gaming devices use devices such as reels or wheels to enhance the attraction of the gaming machines to players and also to enhance the player's game playing experience.

Many known slot gaming devices include a plurality of reels and one or more paylines. Such gaming devices typically include any suitable number of reels, such as three to five reels, which each have any suitable number of symbols, such as three symbols per reel. In these gaming devices, the player initiates the spinning of the reels by making one or more wagers on one or more paylines. Such gaming devices may have one, three, five, nine, fifteen, twenty-five or any other suitable number of paylines which extend horizontally, vertically, diagonally or any combination thereof. The player wagers on a player selected number or combination of paylines, such as one, two, three, five, ten or fifteen paylines and the reels are activated to spin.

After the reels spin to generate a plurality of symbols, the gaming device analyzes the generated symbols to determine if the gaming device has randomly generated a winning symbol or winning symbol combination on one or more of the wagered on paylines. A paytable determines the award that a player wins if a designated winning symbol or designated winning symbol combination occurs on an activated payline. A line pay award typically is calculated by multiplying the award value for the winning symbol or winning symbol combination by the amount wagered upon the payline upon which the winning symbol combination appears. Such calculated awards are provided to the player.

In conventional slot games, for example, if a player wagers one credit on a first payline and another credit on a second payline, the player has activated two paylines. Making an additional wager activates another payline or increases the wager played on an activated payline. This creates a play of the game having a certain number of activated paylines by a certain number of credits per payline.

Most slot machines are set to pay back on average a certain percentage of the amount of money wagered by players. The average percentage of money wagered that is paid back to the player as an award is sometimes called the average expected payback or average expected payback percentage. The average payback provided by a game is determined by the paytable. For example, in a slot game, a paytable determines the award that will be provided to a player if certain winning symbols or winning symbol combinations appear on an activated payline. In gaming devices played at existing gaming terminals, the paytables and winning combinations of the slot machine are predetermined. Thus, although the actual payback may vary, the expected payback for a game is predetermined and remains constant throughout game play.

Gaming device manufacturers constantly strive to make gaming devices that provide as much enjoyment and excitement as possible. It is desirable to provide new games which vary award returns and risk to increase player excitement and enjoyment.

SUMMARY

The present disclosure provides a gaming device that has a paytable selection or modification feature which may be implemented with a primary or base game, a secondary or bonus game, or both. More specifically, the present disclosure provides a processor-controlled game which includes a plurality of different paytables. The gaming device employs an initial, default paytable and enables a player to cause the gaming device to change the employed paytable for one or more plays of the game. If the player chooses to cause the gaming device to change the employed paytable, in one embodiment, the gaming device randomly selects another paytable from the plurality of paytables and determines a game outcome based on the randomly selected paytable. If the player does not choose to cause the gaming device to change the employed paytable, the gaming device determines a game outcome based on the default paytable.

In one embodiment, the gaming device includes plurality of different paytables. Each of the paytables has an average expected payback. In one embodiment, at least two and preferably more of the paytables have a different average expected payback. The game changes in one or more ways based on the paytable selected and played. For example, if a player causes the gaming device to select another paytable, the new paytable may have: (i) a different average expected payback; (ii) a different volatility but the same average expected payback; (iii) a different number of symbols; (iv) different types of symbols; (v) different proportion and/or ordering of symbols; (viii) different types of winning symbol combinations; (ix) a different number of winning symbol combinations; or (x) any combination of these.

In one embodiment, a plurality of the paytables have a different average expected payback. Thus, selecting a new paytable could enable a player to play a game that employs a paytable with a higher average expected payback.

In one embodiment, the volatility of the paytable changes when the paytable changes. The volatility pertains to the range of the values of the awards. In one embodiment, one paytable may include higher and lower award values than another paytable having substantially the same average expected payback. For example, the gaming device could start the game with a first paytable that provides awards of a smaller or moderate size but does so on a relatively frequent basis. If the player chooses to cause the gaming device to change the paytable, the gaming device could randomly select a second paytable associated with higher awards that are provided less frequently. The higher awards can be conventional awards with a higher value than any of the other awards. The higher awards can be jackpot awards, progressive awards, physical prizes such as a new automobile, or any other suitable award or combination of awards. The award disparity creates enhanced levels of excitement for a player because the player can obtain a large award by playing with a more volatile paytable. In one embodiment, the gaming device could select a new paytable, causing the played paytable to change from a more volatile paytable to less volatile paytable. In another embodiment, both the average expected payback and the volatility of the paytable change when the gaming device randomly selects another paytable.

Upon initiation of a play of the game, in one embodiment, the gaming device employs a predetermined or default paytable. In alternative embodiments, the initially employed paytable is randomly determined, determined based on the player's wager, determined based on the player's status (via a player tracking system), determined based on a triggering event, determined based on time, or determined in any other suitable manner. The gaming device displays the employed paytable to a player or makes the employed paytable displayable to the player upon input of a request by the player to see the paytable, as is known in the art. In one embodiment, upon the occurrence of a triggering event, the gaming device may replace the employed paytable with another one of the paytables. That is, when the triggering event occurs, the gaming device randomly selects and displays or makes displayable a new, potentially different paytable from the plurality of different paytables. In one embodiment, the triggering event is a wager placed by the player. In this embodiment, if the player chooses to place the wager, the gaming device randomly selects another paytable from the plurality of paytables. The gaming device determines a game outcome based on the randomly selected paytable and provides the player with the determined game outcome. The gaming device enables the player to play the game one or more times with the employed paytable.

In one embodiment, the gaming device only changes the paytable if the randomly selected paytable gives the player a better advantage in the game. This protects the player from making a wager and obtaining a lesser paytable than the default paytable. Thus, in one embodiment, a plurality of the other or alternative paytables are better for the player than the default paytable. In one embodiment, the paytables are better for the player in one or more different manners, such as by having higher average expected payback or higher awards, and to different extents.

In one embodiment, the gaming device includes a first or default paytable and a plurality of second different paytables. The gaming device enables the player to cause a play of the game, such as by placing a wager. If the player places a first wager amount, the gaming device employs the first paytable in the game and determines a game outcome based on the first paytable. If the player places a second wager amount to cause a play of the game, the gaming device randomly selects one of the second different paytables to employ in the game and determines a game outcome based on the second different paytable. In one embodiment, the second wager amount is greater than or includes the first wager amount. In some embodiments, the first and second wager amounts can be placed at the same time. Alternatively, the first and second wager amounts can be placed separately.

In one embodiment, if the player places the second wager amount to cause a play of the game, the gaming device randomly selects one of the second different paytables and determines whether the average expected payback of the randomly selected paytable is higher than the average expected payback of the first paytable. If the average expected payback of the randomly selected paytable is higher than the average expected payback of the first paytable, the gaming device determines a game outcome based on the randomly selected paytable. If the average expected payback of the randomly selected paytable is not higher than the average expected payback of the first paytable, the gaming device determines the game outcome based on the first paytable. Thus, in this embodiment, the player has a chance of obtaining a better advantage in the game when the player makes the second wager to cause the gaming device to select another paytable. In other embodiments, the gaming device changes the paytable regardless of whether the gaming device randomly selects another paytable that gives the player a better advantage in the game.

The paytable selection feature of the present disclosure may be implemented in a primary or base game, a secondary or bonus game, or both. In one primary game embodiment, a player makes a designated wager to initiate the game. In an alternative embodiment, the present disclosure is applied to a secondary or bonus game, which is played in combination with a base or primary game.

In one embodiment, the gaming device includes a primary game and a secondary game. The gaming device enables the player to place a wager to cause a play of the primary game. If the player places a first wager amount, the gaming device employs a first paytable in the secondary game and determines the a secondary game outcome on the first paytable. If the player places a second, different wager amount to cause a play of the primary game, the gaming device randomly selects a second, different paytable to employ in the secondary game and determines the secondary game outcome based on the randomly selected paytable.

In another embodiment, the gaming device includes a plurality of award generators in a game, wherein each of the award generators has an average expected payout. Upon a triggering event, the gaming device selects an award generator from the plurality of award generators. In one embodiment, the game is a primary game, and the triggering event is a primary game wager placed by the player. In another embodiment, the game is a bonus game, and the triggering event occurs in a primary game. In one embodiment, the gaming device selects a predetermined one of the award generators. In different embodiments, the selected award generator is randomly determined, determined based on the player's wager, determined based on the player's status (via a player tracking system), determined based on a triggering event, determined based on time, or determined in any other suitable manner.

The gaming device enables the player to cause the gaming device to change the selected award generator. If the player chooses to cause the gaming device to change the selected award generator, the gaming device randomly selects another one of the award generators from the plurality of award generators. The gaming device generates an award utilizing the randomly selected award generator. If the player does not choose to cause the gaming device to select another award generator, the gaming device generates an award utilizing the originally selected award generator.

For example, if the gaming device selects a first award generator having an average expected payout of 100, the player can choose to generate an award using the first award generator, or the player can choose to cause the gaming device to randomly select another award generator, in hopes that the gaming device will select an award generator with an average expected payout higher than 100.

In one embodiment, the gaming device requires a wager to cause the gaming device to select another award generator. In this embodiment, if the player places the wager, the gaming device randomly selects another one of the award generators from the plurality of award generators. The gaming device generates an award utilizing the randomly selected award generator and provides the player with the generated award.

In another embodiment, the gaming device provides a limited number of opportunities to the player to cause the gaming device to randomly select another award generator. For example, the number of opportunities may be X number of opportunities, with X being any suitable number greater than 1. The number of opportunities may be predetermined, randomly determined, determined based on the player's wager, determined based on the player's status (via a player tracking system), determined based on a triggering event, determined based on time, or determined in any other suitable manner. It should be appreciated that for each of the opportunities, the gaming device may or may not require an additional wager to cause the gaming device to randomly select another award generator.

In one embodiment, once the gaming device generates an award and provides the generated award to the player, the game ends. In one such embodiment, the player loses any opportunities that were not used in the game. In another embodiment, if there are any opportunities remaining after the gaming device generates an award, the player may continue to play the game until the last opportunity to cause the gaming device to select another award generator is exhausted, whereupon the gaming device generates an award utilizing the most recently selected award generator.

In one embodiment, the award generators are wheels. In this embodiment, each of the wheels includes a plurality of sections. It should be appreciated that the wheels may include any suitable number of sections and the sections may be any suitable size or shape. Each of the sections is associated with one or more awards, wherein the awards of each wheel determine the average expected payback or payout for that wheel. A section indicator is associated with each of the wheels and indicates one of the sections on the respective wheel after that wheel has been activated. In one embodiment, each of the sections of a wheel has the same or substantially the same probability of being indicated after the wheel has been activated. In an alternative embodiment, each of the sections or a plurality of the sections of a wheel are weighted differently to yield a desired average expected payout for that wheel.

In one embodiment, the wheels are mechanical wheels that are attached to the gaming device cabinet and the processor of the gaming device causes the wheels to physically spin. In another embodiment, the wheels are in a video format displayed by a video display device of the gaming device.

In one embodiment, upon initiation of the game, the gaming device selects a predetermined one of the wheels from the plurality of wheels. In different embodiments, the selected wheel is randomly determined, determined based on the player's wager, determined based on the player's status (via a player tracking system), determined based on a triggering event, determined based on time, or determined in any other suitable manner. The gaming device enables the player to cause the gaming device to change the selected wheel. If the player chooses to cause the gaming device to change the selected wheel, the gaming device randomly selects another wheel from the plurality of wheels. The gaming device spins the randomly selected wheel to generate an award. If the player does not choose to cause the gaming device to change the selected wheel, the gaming device spins the originally selected wheel to generate an award. Alternatively, the gaming device enables the player to spin the wheel (by activating an input). When the wheel stops spinning, the gaming device provides the player with the award associated with the section indicated by the section indicator associated with the spun wheel.

It is therefore an advantage of the present disclosure to provide a gaming device that enables a player to have a direct impact on changing the paytable employed by the gaming device.

Another advantage of the present disclosure is to provide a gaming device wherein a player receives several opportunities to obtain a different paytable for a play of a game.

A further advantage of the present disclosure is to provide a gaming device that has variability in awards.

Another advantage of the present disclosure to increase player excitement by dynamically changing the possible awards in a game and increasing the level of player interaction.

Other objects, features and advantages of the disclosure will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 3A, 3B, and 3C are schematic views of three example paytables of one embodiment of the present disclosure, wherein each paytable is associated with an average expected payback.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
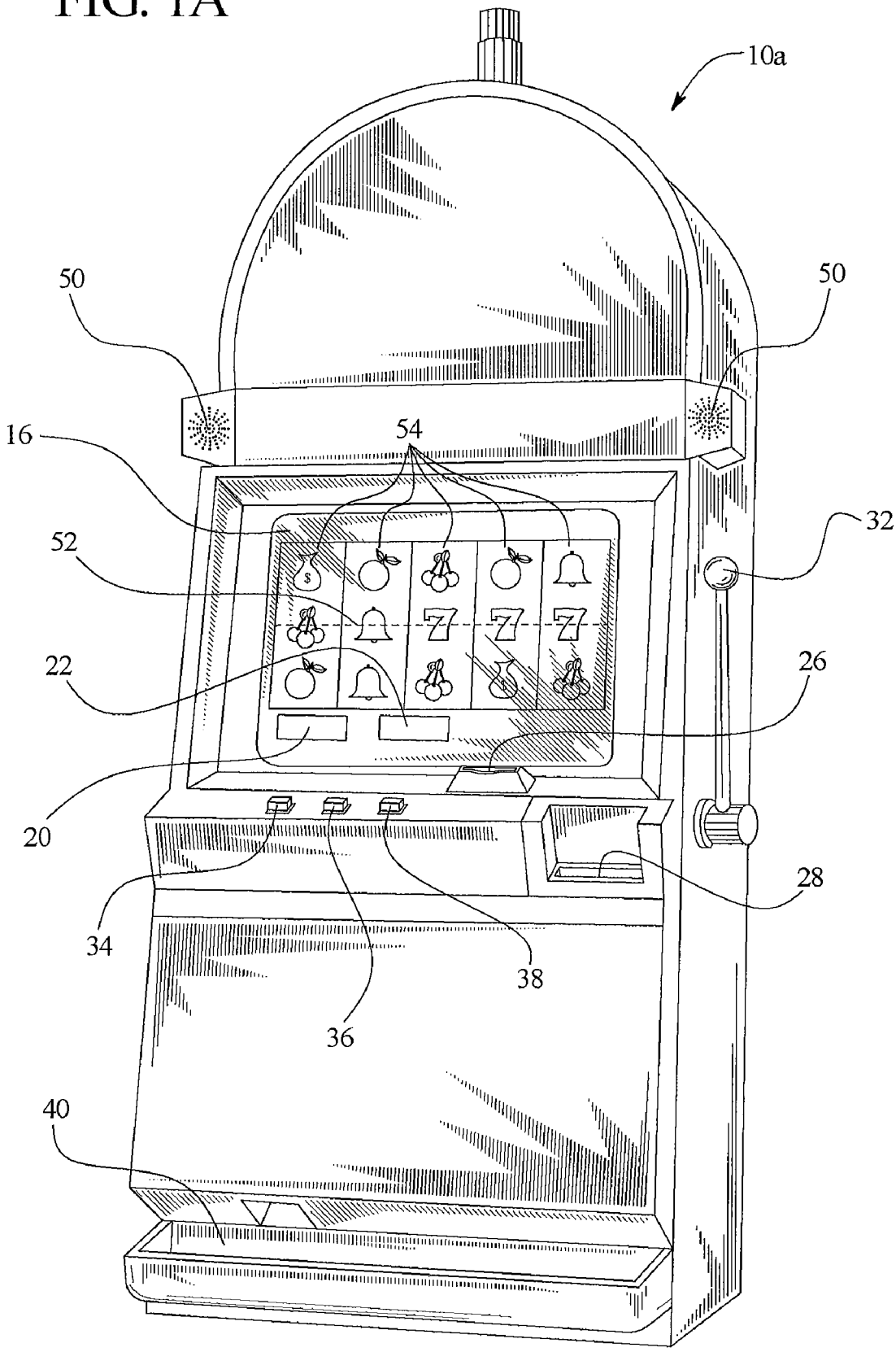
FIGS. 1A, 1B and 1C are perspective views of example alternative embodiments of the gaming device of the present disclosure.
Figure 1B:
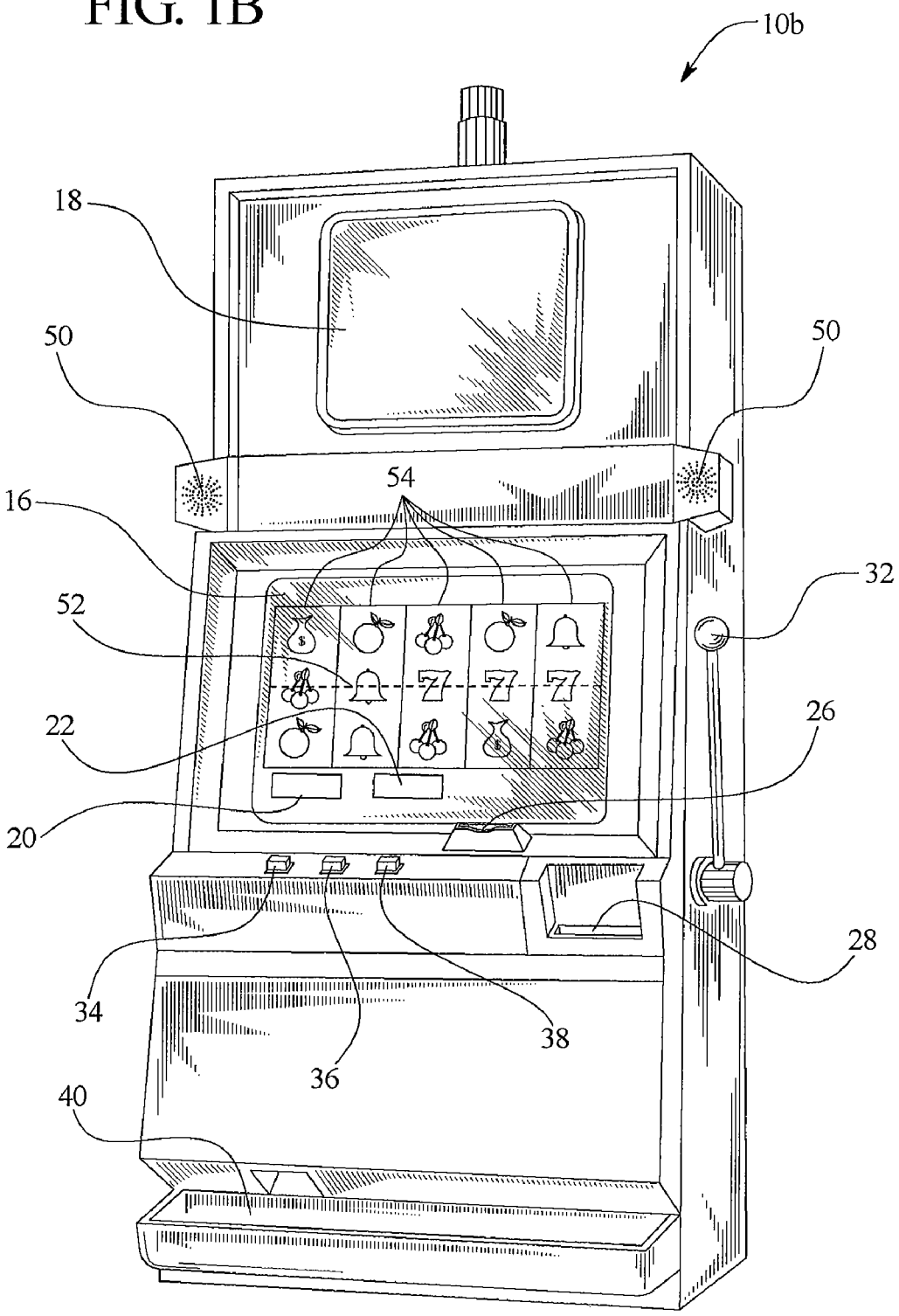
Figure 1C:
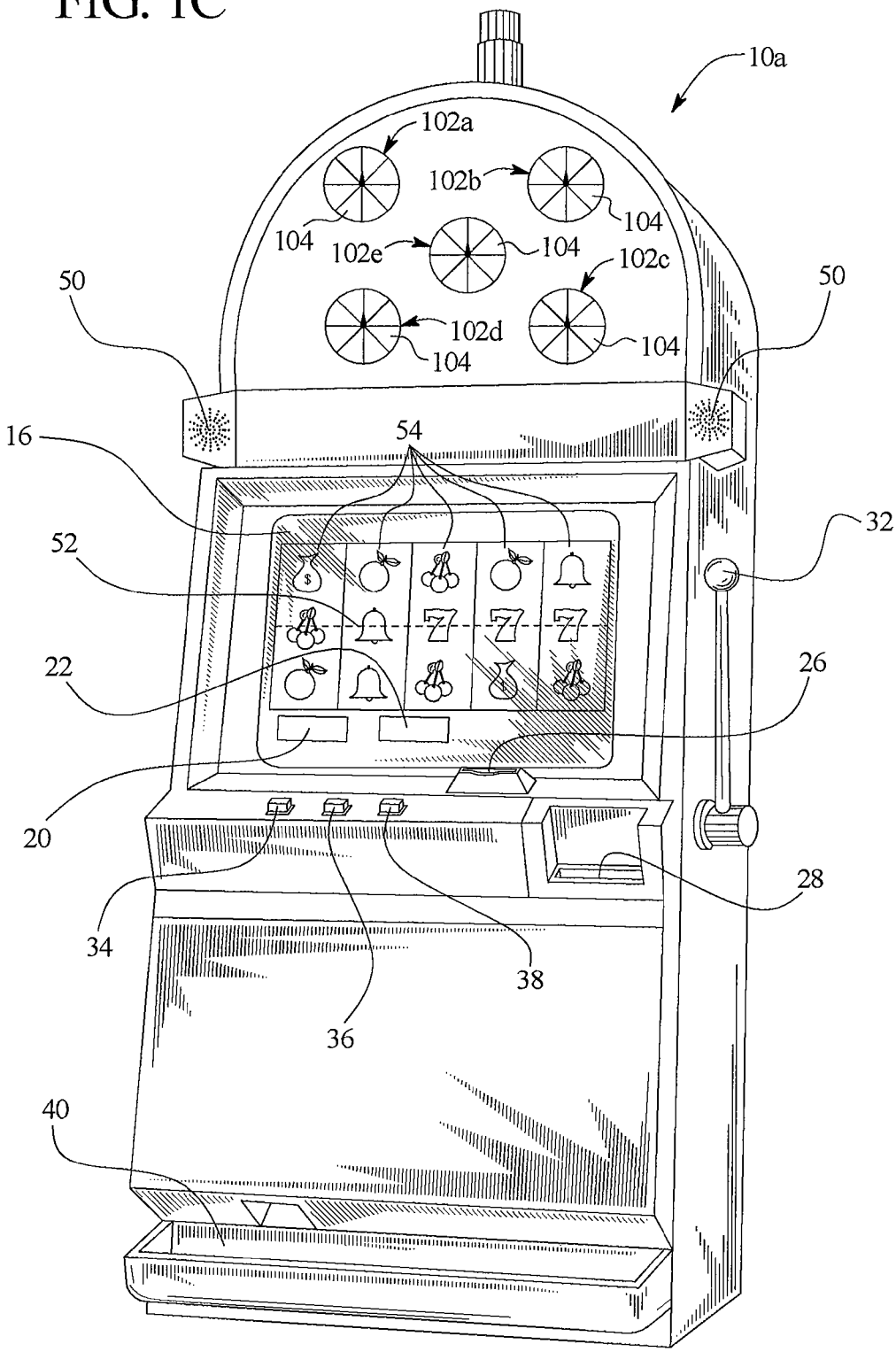

Referring now to the drawings, two example alternative embodiments of the gaming device of the disclosed herein are illustrated in FIGS. 1A 1B, and 1C as gaming device 10*a*, gaming device 10*b*, and gaming device 10*c*, respectively. Gaming device 10*a*, gaming device 10*b*, and/or gaming device 10*c* are generally referred to herein as gaming device 10.

In the embodiments illustrated in FIGS. 1A, 1B, and 1C, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A, 1B, and 1C, the gaming device may have varying cabinet and display configurations.

Figure 2A:
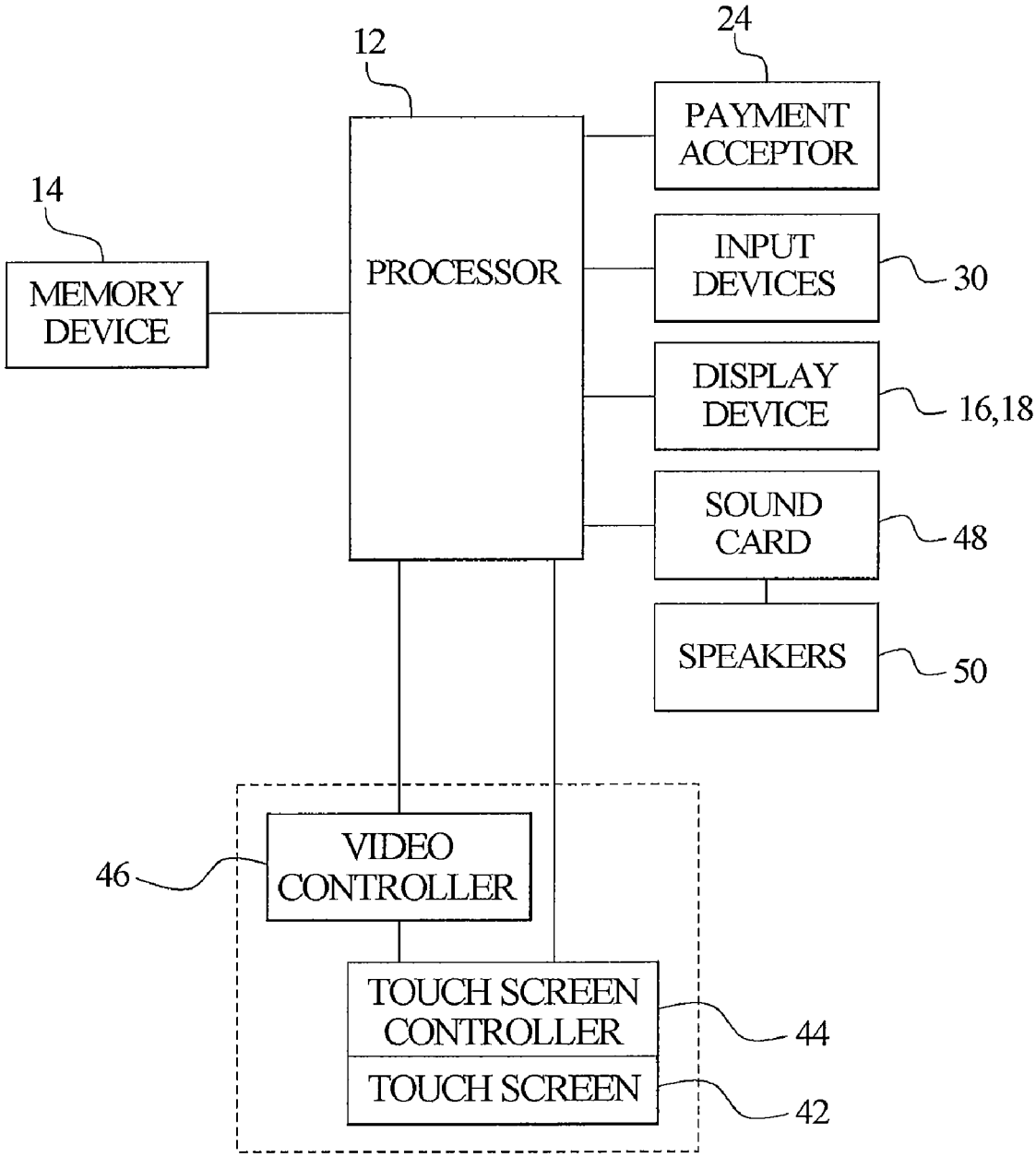
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A, 1B, and 1C, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition Of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

In one embodiment, as illustrated in FIG. 1C, the gaming device includes a plurality of electromechanical award generators 102*a*, 102*b*, 102*c*, 102*d*, and 102*e*, such as rotatable wheels, reels, or dice, which are each attached to the housing of the gaming device 10. In one embodiment, the award generators are arranged in the pattern as illustrated in FIG. 1C. In another embodiment, the award generators are arranged in any suitable configuration. In one embodiment, as shown in FIG. 1C, wherein the award generators are each a rotatable wheel, each wheel includes a plurality of sections 104, wherein each section displays an award, symbol, outcome, image, or other suitable indicia. In this embodiment, each mechanical rotatable wheel is associated with and connected to a suitable actuator or motor (not shown) which is controlled by the processor. The associated actuator or motor is adapted to drive or rotate the wheel in a clockwise or counter-clockwise direction. In an alternative embodiment, any suitable electromechanical device which preferably moves one or more interacting objects, such as one or more reels or dice, which are configured to display at least one and preferably a plurality of games or other suitable images, symbols, or indicia may be employed with the present disclosure.

As illustrated in FIG. 2A, in one embodiment, the gaming device includes at least one payment acceptor 24 in communication with the processor. As seen in FIGS. 1A, 1B, and 1C the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, 1C, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A, 1B, and 1C, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A, 1B, and 1C, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award, to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A, 1B, and 1C. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
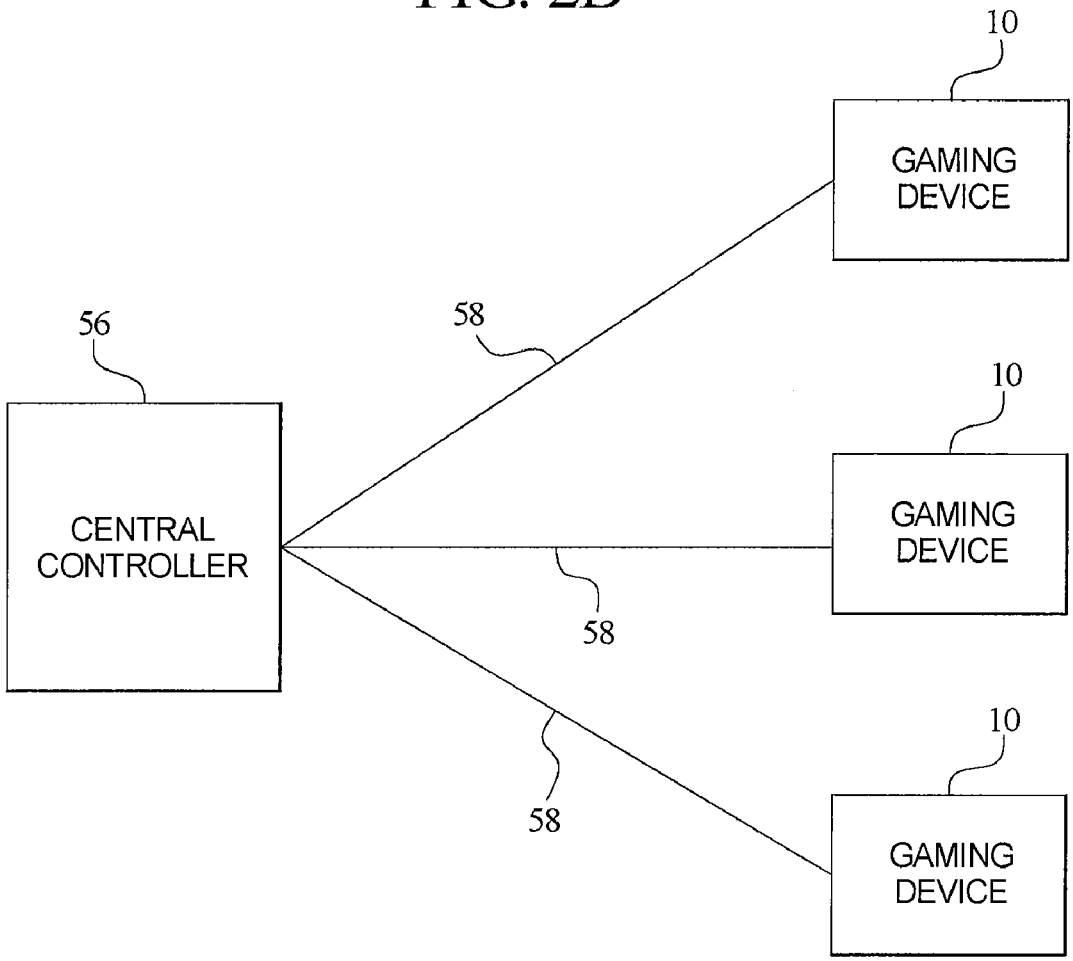
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an Internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming, device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Gaming Device Having Purchasable Randomly Selected Paytables

Referring now to FIGS. 3A, 3B, and 3C, one embodiment of the present disclosure includes a plurality of different paytables: Paytable A 202*a*, Paytable B 202*b*, and Paytable C 202*c*. Each paytable includes symbols or symbol combinations that produce respective awards for the player. The symbol combinations, their respective awards, and the chance of said symbol combinations occurring (not shown) of each of Paytable A 202*a*, Paytable B 202*b*, and Paytable C 202*c* determine the average expected payback for that paytable. It should be appreciated that for illustration purposes, FIGS. 3A, 3B, and 3C display a sampling of the different symbol combinations (i.e., four symbol combinations) in Paytable A 202*a*, Paytable B 202*b*, and Paytable C 202*c*. It should be appreciated that Paytable A 202*a*, Paytable B 202*b*, and Paytable C 202*c* do not show losing or non-winning outcomes or other potential winning outcomes.

Each paytable has an average expected payback and a volatility. In one embodiment of the present disclosure, a plurality of the paytables have different average expected paybacks. For example, as shown in FIGS. 3A and 3B, the average expected payback for Paytable A 202*a* (98%) is different from the average expected payback for Paytable B 202*b* (96%). In one embodiment, each of the paytables has a different average expected payback. In another embodiment, a plurality of the paytables have the same average expected payback. For example, Paytable A 202*a* and Paytable C 202*c* have the same average expected payback (98%), as illustrated in FIGS. 3A and 3C. In another embodiment, each of the paytables has the same average expected payback.

In one embodiment, a plurality of the paytables have different volatilities. In another embodiment, each of the paytables have different volatilities. For example, as shown in FIGS. 3A, 3B, and 3C, Paytable B 202*b* has greater volatility than Paytable A 202*a* and Paytable C 202*c*. That is, the range of possible awards in Paytable B 202*b* is greater than the range of possible awards in Paytable A 202*a* and Paytable C 202*c* (i.e., the awards in Paytable B 202*b* have a volatility range of 99,999 between the lowest possible award and the highest possible award). In another embodiment, a plurality of the paytables have the same volatility. In another embodiment, each of the paytables have the same volatility.

As illustrated in FIGS. 3A, 3B, and 3C, Paytable A 202*a*, Paytable B 202*b*, and Paytable C 202*c* display symbols or symbol combinations that produce respective awards for the player. It should be appreciated that a paytable can have any number of winning symbols or winning symbol combinations. In one embodiment, a plurality of the paytables have the same number of winning symbols or symbol combinations. In another embodiment, a plurality of the paytables have a different number of winning symbols or symbol combinations. In one embodiment, a plurality of the paytables have the same type of winning symbols or symbol combinations. In another embodiment, a plurality of the paytables have different types of winning symbols or symbol combinations. In other embodiments, a plurality of the paytables have both different numbers of winning symbols or symbol combinations and different types of winning symbols or symbol combinations.

For example, a first paytable may have N symbols, where N is equal to 512, and a 90% average expected payback. A second paytable may include M symbols, where M is equal to 1024. The second paytable may have different symbols, the same symbols, or additional symbols as the first paytable. In one example, the second paytable includes a CAR symbol, which represents the prize of winning a car, and the first paytable does not include a CAR symbol. Thus, the second paytable has the CAR symbol, which does not exist on the first paytable, and the second paytable also has more symbols than the first paytable (i.e., the second paytable has M, or 1024, symbols while the first paytable has N, or 512, symbols). The second paytable has a higher average expected payback (i.e., 92%) that includes the CAR symbol in the second paytable.

In another example, a first paytable and a second paytable each have the same number of symbols. The first paytable includes one CAR symbol and has an average expected payback of 90%. The second paytable includes two CAR symbols and has an average expected payback of 92%. The first paytable and the second paytable have the same number of symbols, but the higher frequency of the CAR symbol in the second paytable causes the second paytable to have a higher average expected payback than the first paytable.

In another example, a first paytable and a second paytable have the same average expected payback, but each of the paytables has a different arrangement of symbols. In this example, the player does not get any advantage by playing with the second paytable instead of the first paytable.

Figure 4A:
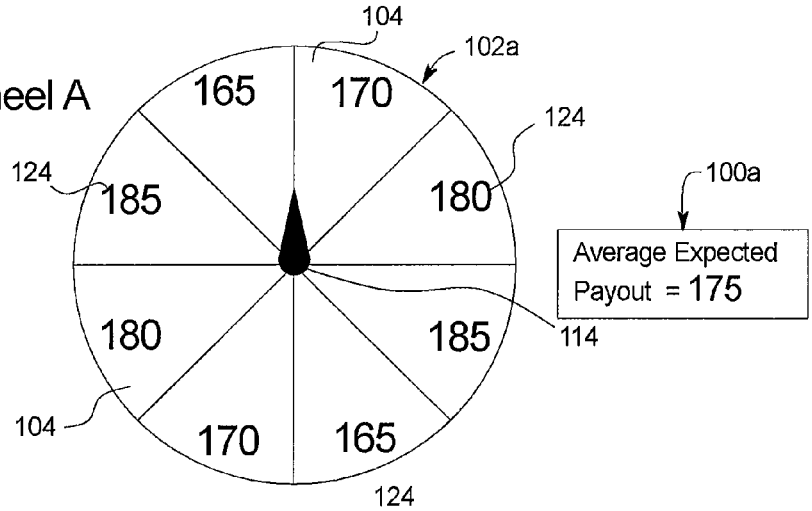
FIGS. 4A, 4B, and 4C are schematic views of example award generators of one embodiment of the present disclosure, wherein the award generators are wheels, and each award wheel is associated with an average expected payout.
Figure 4B:
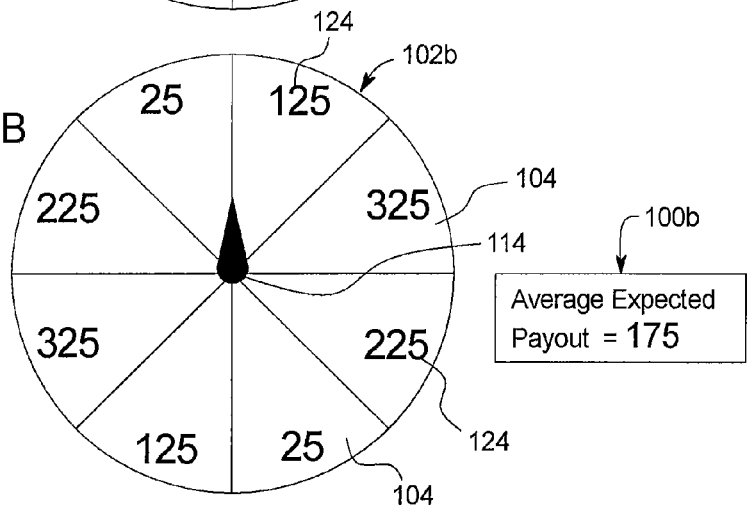
Figure 4C:
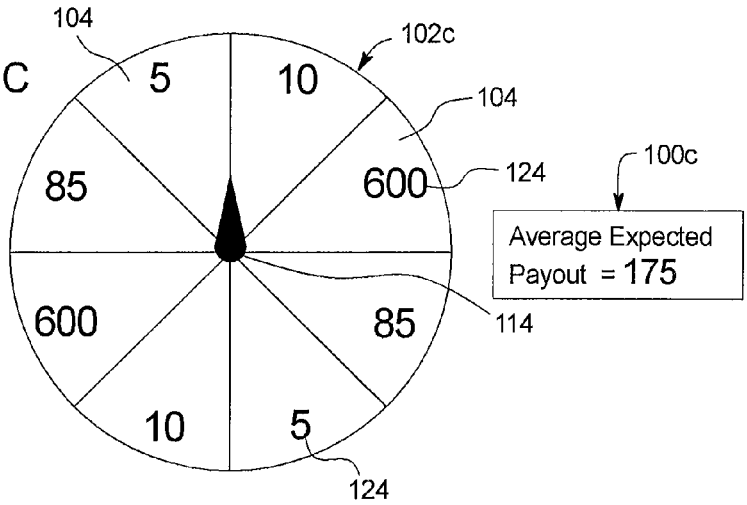

Referring now to FIGS. 4A, 4B, and 4C, the gaming device includes a plurality of award generators represented by award wheels: Award Wheel A 102*a*, Award Wheel B 102*b*, and Award Wheel C 102*c*. Award Wheel A 102*a*, Award Wheel B 102*b*, and Award Wheel C 102*c* are each associated with the same average expected payout, but each has a different volatility. The volatility pertains to the range of the values of the awards. Award Wheel A 102*a* has the lowest volatility, Award Wheel B 102*b* has a medium volatility and Award Wheel C 102*c* has the highest volatility. For example, the lowest award for Award Wheel A 102*a* is 165. The highest award for Award Wheel A 102*a* is 185. Thus, the awards in Award Wheel A 102*a* have a volatility range of 25 between the lowest possible award and the highest possible award.

In the examples of FIGS. 4A, 4B, and 4C, the awards each have the same probability of being generated in a spin of the award wheel. Therefore, the average expected payout is 175 for each spin of the award wheel. It should be appreciated that, in other embodiments, the sections of a wheel may be weighted differently to yield a desired average expected payout for that wheel. That is, each section or a plurality of the sections on the wheel may have a different probability of being indicated.

Award Wheel B 102*b* has a volatility range of 300 (325−25) and an average expected payout for each of the eight wins of 175 ((25+125+225+325+25+125+225+325)/8). Award Wheel C 102*c* has a volatility range of 595 (600−5) and an average expected payout for each of the eight wins of 175 ((5+600+85+10+5+600+85+10)/8). Thus, each of the award wheels has a different volatility and the same average expected payout (i.e., 175). The average expected payout will be the same or substantially the same regardless of which of the award wheels the gaming device employs in the game.

Figure 5:
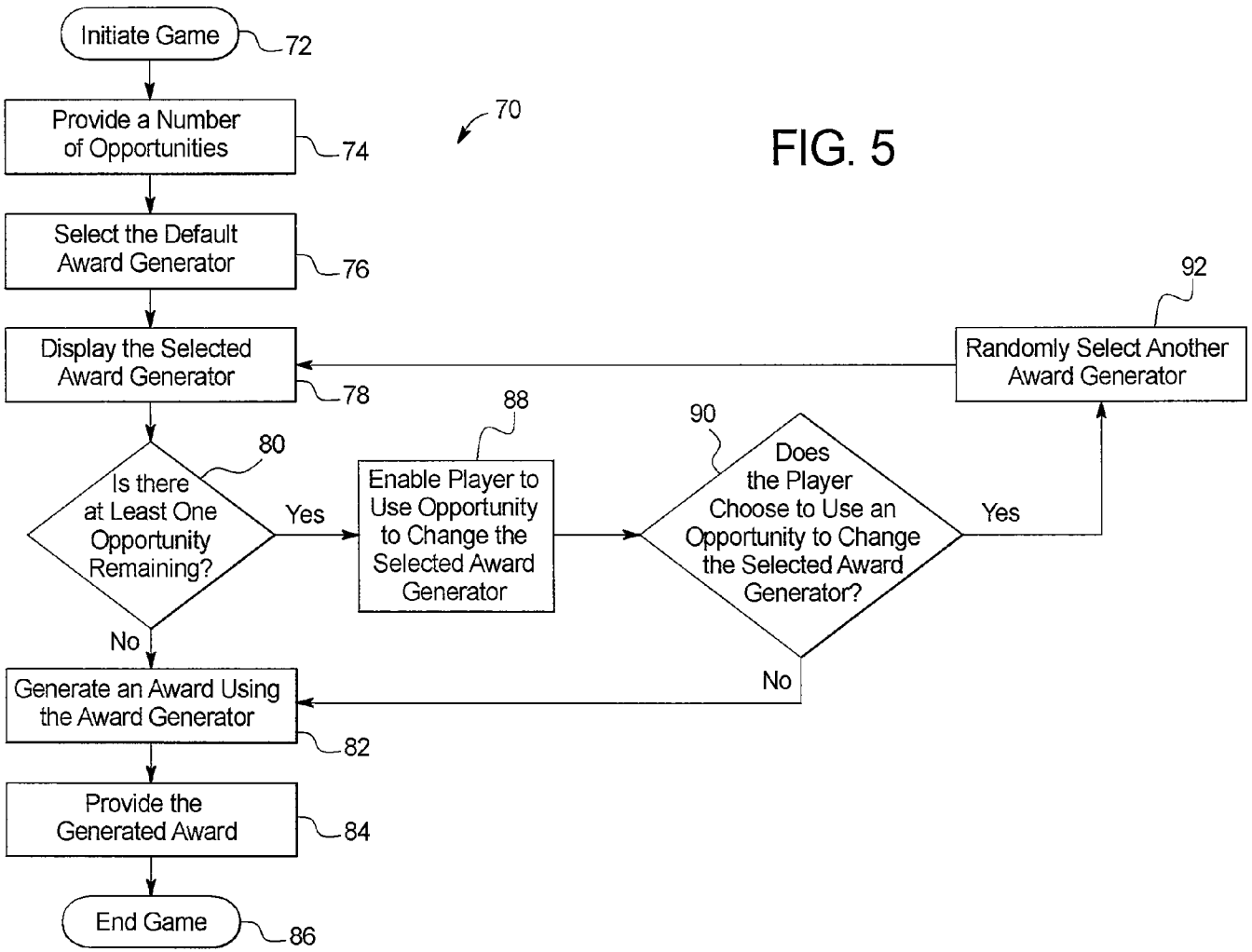
FIG. 5 is a process flow diagram showing one possible flow sequence of one embodiment of the present disclosure.

Referring now to FIG. 5, one embodiment of a game operates according to sequence 70. Sequence 70 starts as indicated by oval 72. It should be appreciated that, in one embodiment, the present disclosure is applied to a secondary or bonus game, which is played in combination with a base or primary game. In one such embodiment, a triggering event in the base or primary game triggers the secondary or bonus game. In an alternative embodiment, the present disclosure is applied to a base or primary game. In one such embodiment, a player makes a designated wager to initiate the game.

As illustrated in FIG. 5, upon initiation of the game, the gaming device 10 provides a number of opportunities to a player as indicated by block 74. The number of opportunities provided to the player can be predetermined, randomly determined, determined based on the player's wager, determined based on the player's status (via a player tracking system), determined based on a triggering event, determined based on time, or determined in any other suitable manner. Each opportunity represents a chance to change one or more aspects of the gaming device 10.

As indicated by block 76, the gaming device 10 selects a predetermined initial or default award generator. In different embodiments, the gaming device selects an initial award generator that is randomly determined, determined based on the player's wager, determined based on the player's status (via a player tracking system), determined based on a triggering event, determined based on time, or determined in any other suitable manner. The gaming device displays the selected award generator, as indicated by block 78. After displaying the selected award generator, the gaming device 10 determines if there is at least one opportunity remaining in the game as indicated by decision diamond 80.

If the gaming device 10 determines that there is at least one opportunity remaining in the game, the gaming device enables the player to use an opportunity to change the award generator as indicated by block 88. The gaming device 10 determines whether the player chooses to use an opportunity to change the selected award generator, as illustrated by decision diamond 90. In one embodiment, the player uses an opportunity to change the award generator by placing a wager. If the player chooses to use an opportunity to change the selected award generator, the gaming device 10 randomly selects another award generator from the plurality of award generators as indicated by block 92. The gaming device 10 repeats the process starting at block 78.

If the gaming device 10 determines at decision diamond 90 that the player does not choose to use an opportunity to change the selected award generator, the gaming device 10 generates an award using the selected award generator as indicated by block 82. The gaming device 10 provides the generated award, and the game ends as indicated by block 84 and oval 86, respectively.

In the embodiment illustrated by sequence 70, the game ends after the gaming device 10 provides an award to the player. In one primary game embodiment of the present disclosure, the player has the opportunity to wager another amount to play the game again or cash out any credits and discontinue gaming. If the present disclosure is provided in a secondary or bonus game, in one embodiment, game play returns to that of the associated primary game, and gaming device 10 enables the player to wager any credits from sequence 70.

In an alternative embodiment, if the player has opportunities remaining in the game after the gaming device generates an award using the award generator and provides the generated award to the player, the game does not end. In one such embodiment, the gaming device 10 displays the award generator that was used to generate an award and repeats the process described above starting at decision diamond 80. When there are no opportunities to change the selected award generator remaining in the game, the gaming device generates an award using the award generator, and the player receives the total award for the game.

Referring now generally to FIGS. 6A to 6K, an example of one embodiment of the present disclosure is illustrated where the gaming device provides a player with five opportunities in a game. It should be appreciated that the game could start with any suitable number of opportunities desired by the game implementor. It should be appreciated that the starting number of opportunities could be predetermined, randomly determined, determined based on the player's wager, determined based on the player's status (via a player tracking system), determined based on a triggering event, determined based on time, or determined in any other suitable manner.

The game includes a plurality of award generators represented by award wheels 102. Each award wheel 102 includes a mechanical or video wheel having a plurality of sections 104. Each of the award wheels 102 is divided into or includes a plurality of sections 104. Any suitable number of sections may be employed by the implementor of the gaming device of the present disclosure. A section indicator 114 is associated with each of the wheels and indicates one of the sections 104 on the wheels after that wheel has been activated in a spin. An award symbol 124 is on or otherwise associated with each section 104. One or more awards are associated with the award symbols 124. The awards may be any suitable award such as values, credits, free spins, free games, multipliers or award opportunities as desired by the game implementor.

In one embodiment, each of the awards associated with each of the wheels are different. In another embodiment, a plurality of the awards are different. In another embodiment, the plurality of awards associated with each of the wheels are the same. In another embodiment, the average expected payout associated with each wheel is different. In another embodiment, the average expected payout associated with each wheel is the same. In another embodiment, the average expected payout associated with each wheel is the same, but the volatility of each wheel is different.

Figure 6A:
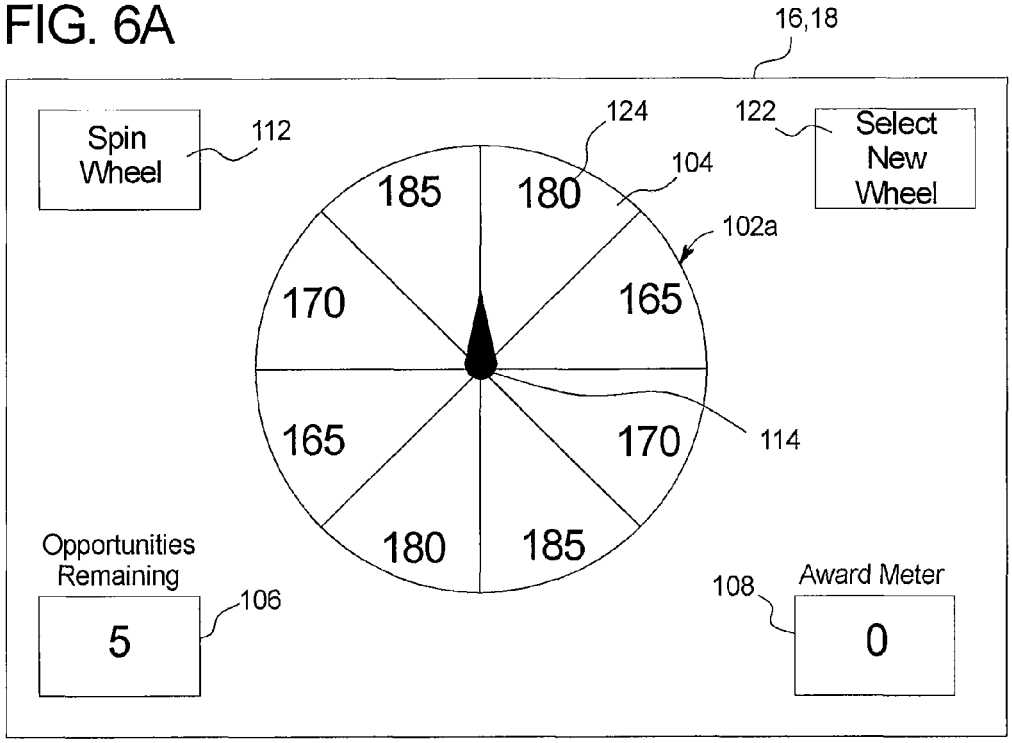
FIGS. 6A, 6B, 6C, 6D, 6E, 6F, 6G, 6H, 6I, 6J, and 6K are enlarged front plan views of a display device of the gaming device disclosed herein, illustrating an example of one embodiment of the present disclosure where a player is provided with five opportunities in a play of the game.

Referring now to FIG. 6A, display device 16 or 18 illustrates one example of a game play screen at the beginning of the game. For ease of illustration, each of the relevant apparatus is shown on the same display device 16 or 18. In alternative embodiments, the relevant apparatus are split up at different areas of gaming device 10.

The display device 16 or 18 displays award wheel 102*a* to the player, as illustrated in FIG. 6A. Award wheel 102*a* has eight sections 104, each of the sections 104 associated with an award 124. For example, the eight sections 104 are associated with awards 124 having values of 165, 170, 180, 185, 165, 170, 180, and 185. In this example, each of the sections 104 on award wheel 102*a* has an equal probability of being indicated by the section indicator 114 when award wheel 102*a* is activated. Thus, award wheel 102*a* has an average expected payout of 175.

It should be appreciated that, in other embodiments, wheel sections are weighted differently (i.e., each section of the wheel has a different probability of being indicated) to yield a desired average expected payout for that wheel.

The display device 16 or 18 also provides an opportunities remaining display 106. In this example, the gaming device 10 provides the player with five opportunities as indicated in the opportunities remaining display 106 as illustrated in FIG. 6A. Each opportunity represents a chance to change one or more aspects of the gaming device 10. The opportunities remaining display 106 decreases by one after each opportunity used by the player. Thus, at any point in the game, the player knows how many opportunities are remaining in that game.

The display device 16 or 18 further provides an award meter 108. The award meter 108 indicates to the player how many credits or other type(s) of award are provided for playing the game of the present disclosure. During a game, any award received by a player is added to the award indicated by the award meter 108. Once a game ends, the award amount indicated by the award meter 108 is provided to the player. As shown in FIG. 6A, the award meter 108 indicates that the player's award at the beginning of the game is zero.

Figure 6B:
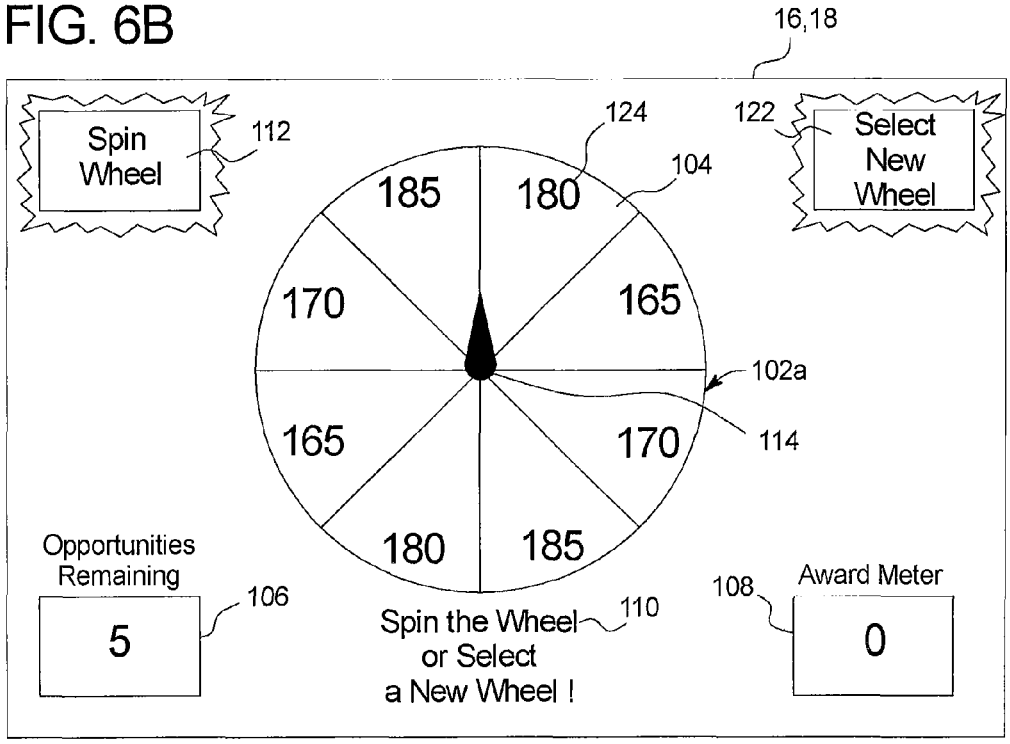

Referring now to FIG. 6B, the gaming device 10 prompts the player to spin award wheel 102*a* or to use one of the provided opportunities to cause the gaming device 10 to select a different award wheel from the plurality of award wheels. In one embodiment, the player uses an opportunity to change the award wheel by placing a wager. As indicated by the opportunities remaining display 106, the player has five opportunities to cause the gaming device 10 to select a new award wheel from the plurality of award wheels. The display device 16 or 18 displays an audio, visual, or audiovisual message 110 and illuminates the "spin the wheel" button 112 and the "select new wheel" button 122, prompting the player to either spin award wheel 102*a* (i.e., by pressing the "spin the wheel" button 112) or cause the gaming device 10 to select a different award wheel (i.e., by pressing the "select new wheel" button 122). Because the player has not yet won an award, the award meter 110 in FIG. 6B shows that the award is zero.

Figure 6C:
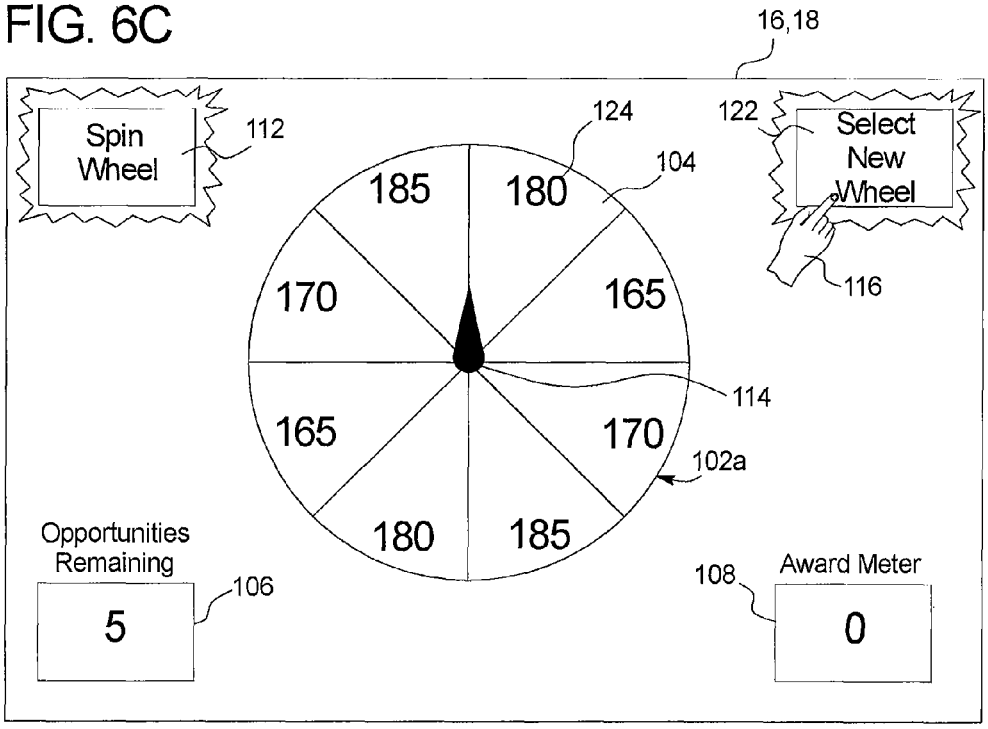
Figure 6D:
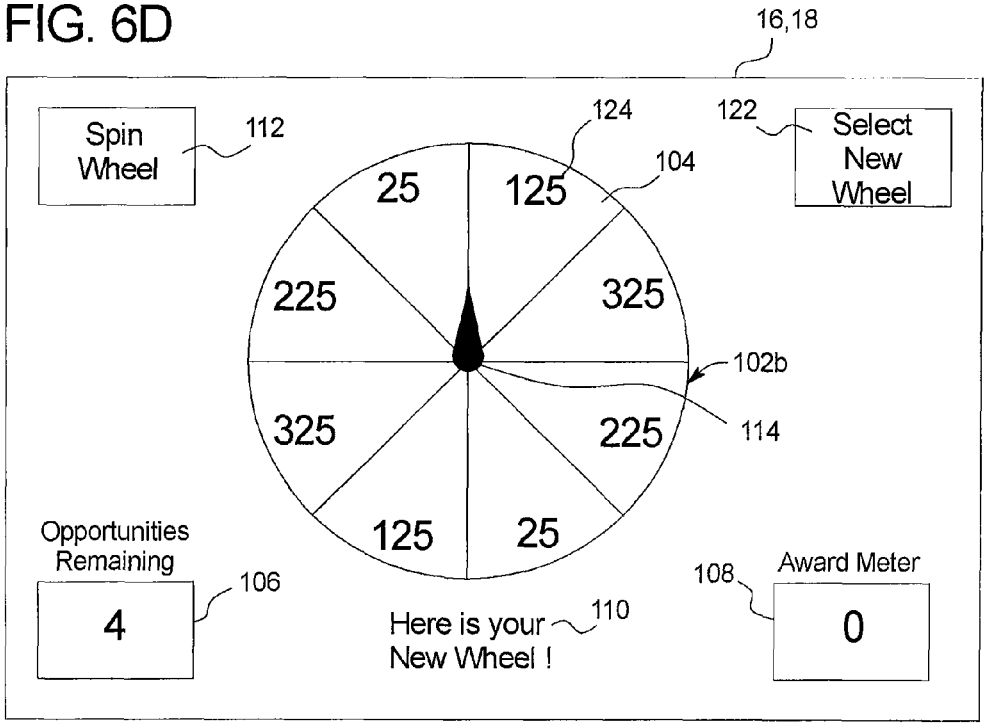

In FIG. 6C, a player 116 presses the "select new wheel" button 122, indicating the player's decision to use one of the provided opportunities to change the award wheel 102*a*. FIG. 6D illustrates the gaming device 10 displaying different award wheel 102*b* after receiving the player's wager. Award wheel 102*b* has eight sections 104, each of the sections 104 associated with an award 124. The eight sections 104 of award wheel 102*b* are associated with awards 124 having values of 25, 125, 325, 225, 25, 125, 325, and 225. Each of the sections 104 on award wheel 102*a* has an equal probability of being indicated by the section indicator 114 when award wheel 102*b* is activated. Thus, award wheel 102*b* has an average expected payout of 175. It should be appreciated that, in this example, award wheel 102*b* has the same average expected payout as award wheel 102*a*, but award wheel 102*b* has greater volatility than award wheel 102*a* (i.e., award wheel 102*b* has a greater range between the lowest possible award and the highest possible award). Thus, the player has the opportunity to win one or more larger awards with award wheel 102*b*.

As illustrated in FIG. 6D, the number in the opportunities remaining display 106 goes down by one and shows the number four because the player used one of the opportunities to cause the gaming device 10 to select a new award wheel. The award meter 108 indicates that the player has not obtained an award from play of the game.

Figure 6E:
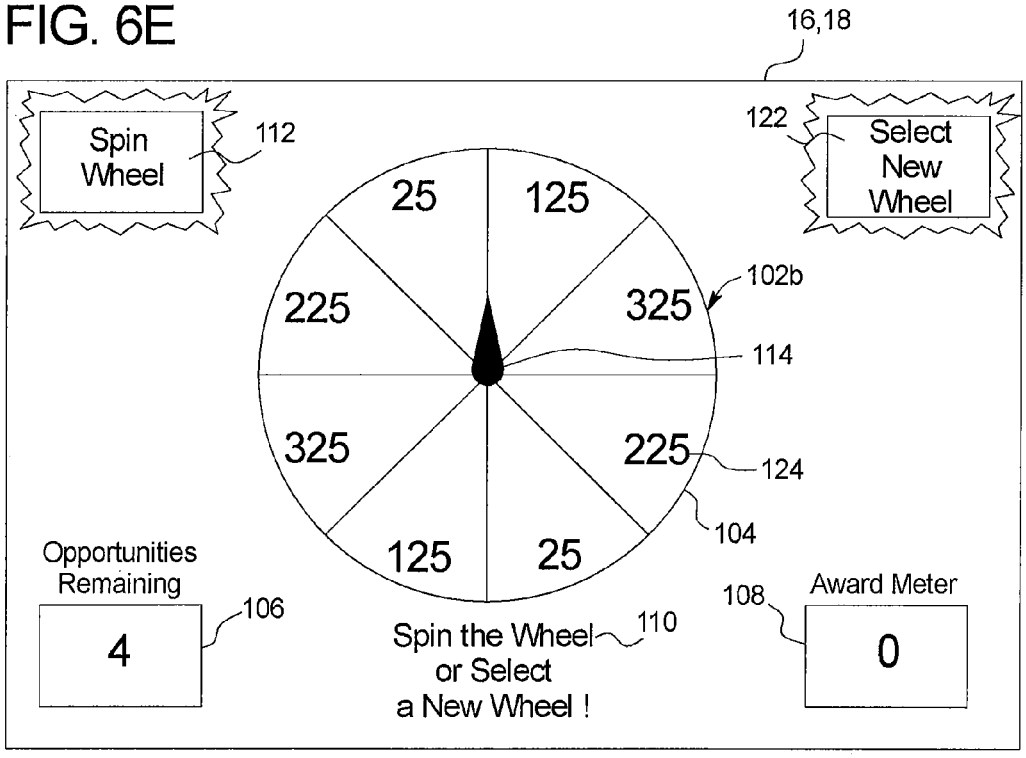

In FIG. 6E, gaming device 10 prompts the player to spin award wheel 102*b* or to use one of the provided opportunities to select a new wheel. The display device 16 or 18 displays an audio, visual, or audiovisual message 110 and illuminates the "spin the wheel" button 112 and the "select new wheel" button 122, prompting the player to either spin award wheel 102*a* or cause the gaming device to select a new wheel. The opportunities remaining display 106 shows four opportunities remaining. The award meter 108 indicates that the award is zero.

Figure 6F:
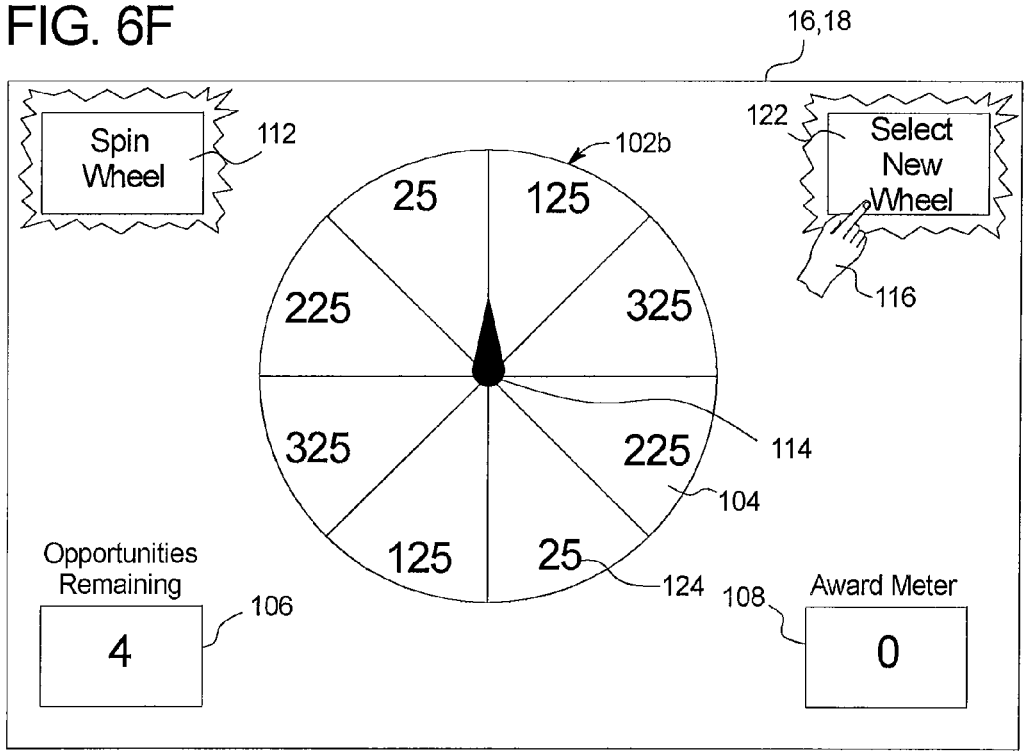

In FIG. 6F, the player 108 uses one of the remaining opportunities to press the "select new wheel" button to cause the gaming device 10 to select a new award wheel.

Figure 6G:
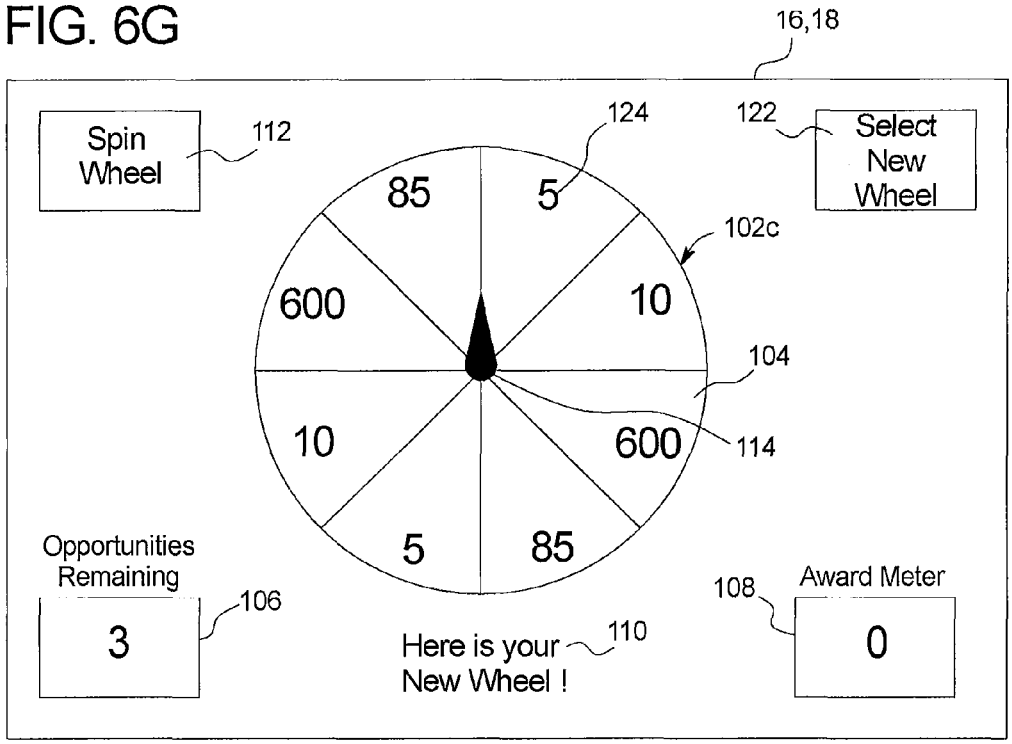

In FIG. 6G, display device 16 or 18 displays new award wheel 102*c*. Award wheel 102*c* also has eight sections 104, each of the sections 104 associated with an award 124. The eight sections 104 of award wheel 102*c* are associated with awards 124 having values of 5, 10, 85, 600, 5, 10, 85, and 600. Each of the sections 104 on award wheel 102*a* has an equal probability of being indicated by the section indicator 114 when award wheel 102*b* is activated in a spin. Similar to previously selected award wheels 102*a* and 102*b*, award wheel 102*c* has an average expected payout of 175. Thus, in this example, award wheel 102*c* has same average expected payout as award wheel 102*a* and award wheel 102*b*, but award wheel 102*c* has greater volatility than award wheel 102*b*. The player has an opportunity to win an even larger award by playing with award wheel 102*c*. The number in the opportunities remaining display 106 decreases by one and shows three opportunities remaining. As illustrated in FIG. 6G, award meter 108 shows that the player has not obtained an award from play of the game.

Figure 6H:
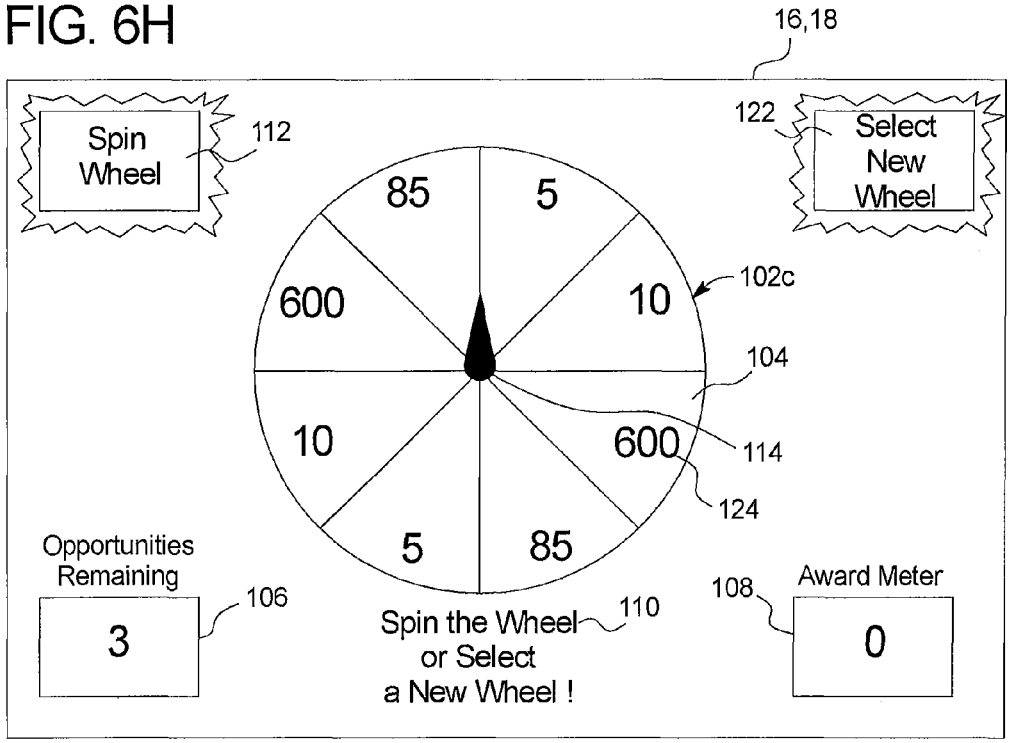

In FIG. 6H, the gaming device 10 prompts the player to spin award wheel 102*c* or to use one of the remaining opportunities to select a new wheel.

Figure 6I:
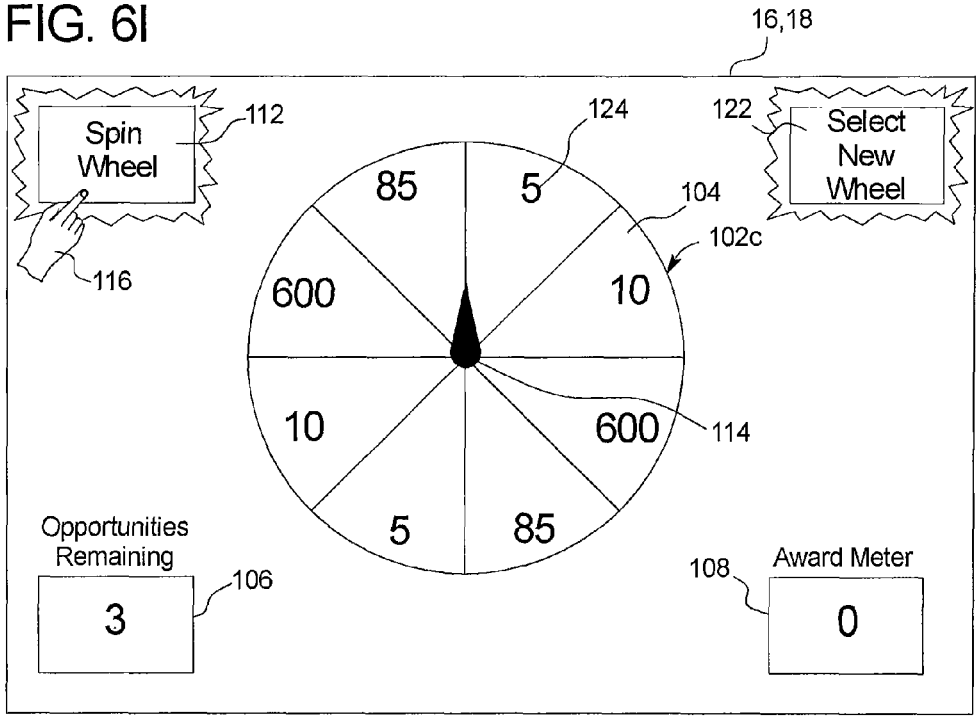

FIG. 6I shows the player 116 pressing the "spin the wheel" button 112 for the first time in the game.

Figure 6J:
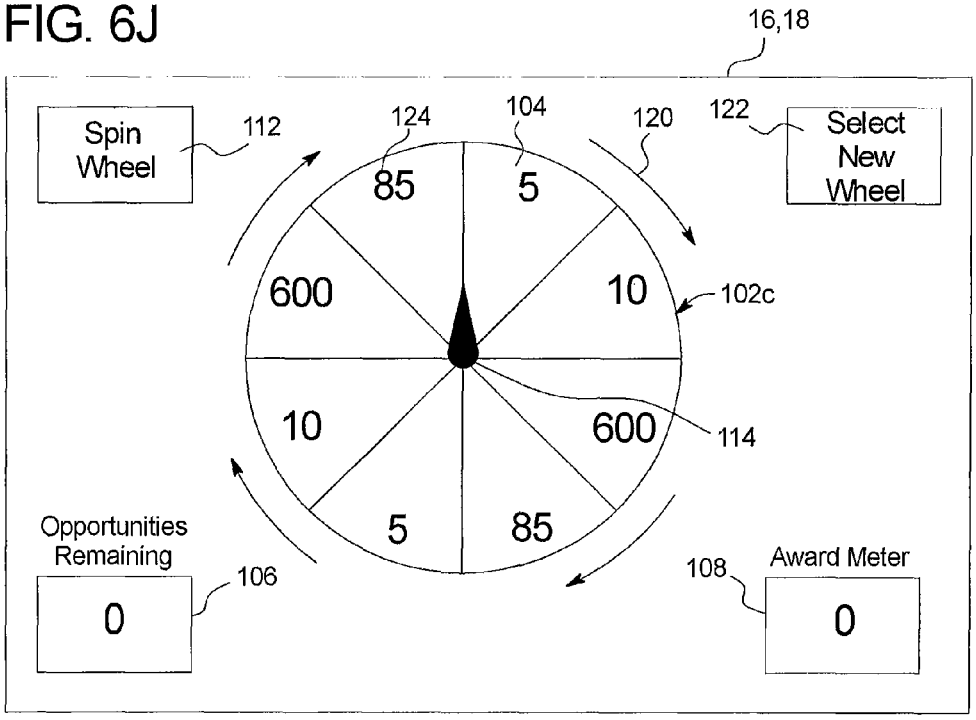

As illustrated in FIG. 6J, the gaming device 10 spins the award wheel for the first time in the game. The award wheel 102*c* spins or rotates in a clockwise direction as shown by arrows 120. It should be appreciated that the award wheels can alternatively spin in a counter-clockwise direction if desired.

Figure 6K:
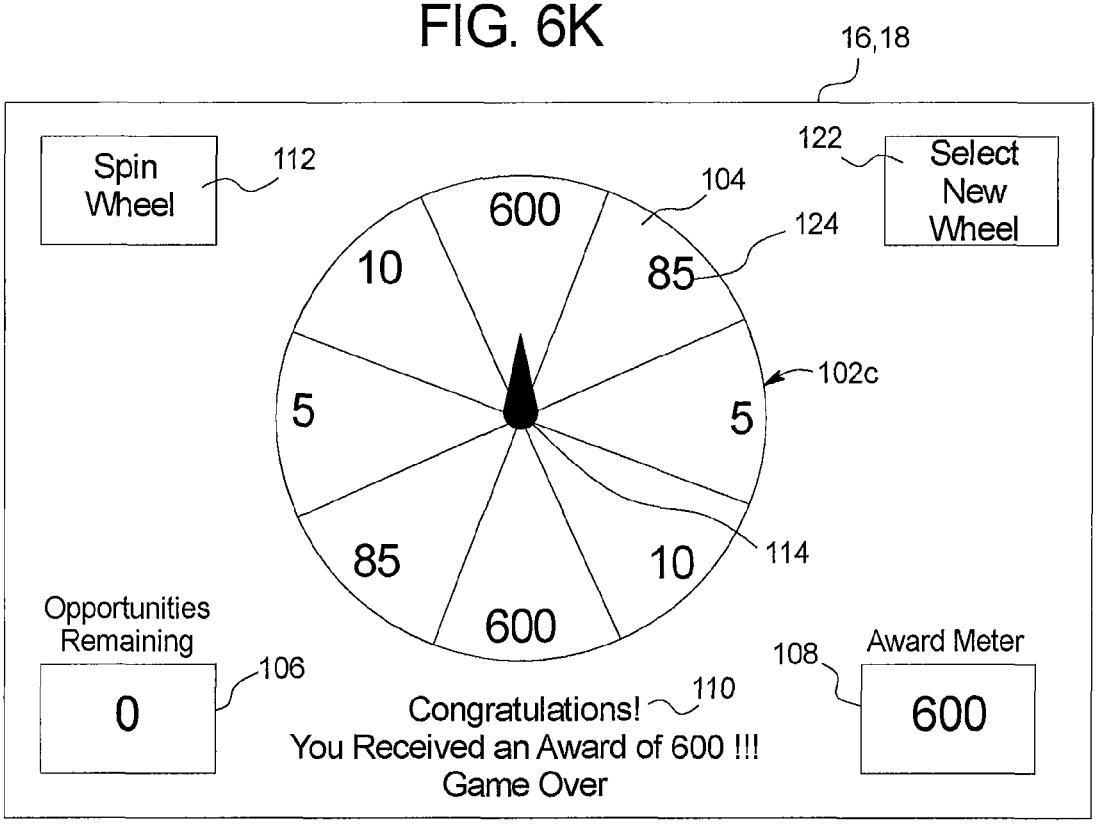

In FIG. 6K, display device 16 or 18 displays award wheel 102*c* after it has stopped spinning, and the section indicator 114 indicates a section 104 having an associated award 124 of 600. The display device 16 or 18 displays an audio, visual, or audiovisual message 110 congratulating the player for obtaining an award of 600 and alerting the player that the game is over. The gaming device 10 provides the player with the award 124. That is, the award 124 of 600 is added to the player's previous award of zero to give the player a total award for the game of 600 as indicated by the award meter 108.

In this example, after the gaming device generates an award and provides the generated award to the player, the game ends. Therefore, although the player only used three of the five provided opportunities to cause the gaming device to select another award wheel, the two opportunities that were not used in the game are lost.

In another embodiment, after the gaming device generates an award, the player may continue to play the game until the last opportunity to cause the gaming device to change the award wheel is exhausted. In this embodiment, when there are no opportunities to change the award wheel remaining in the game, the gaming device generates an award utilizing the selected award wheel.

In another embodiment, the gaming device limits the number of times that the player may cause the gaming device to change the award wheel before the player must spin the award wheel. In this embodiment, the gaming device enables the player to cause the gaming device to change the award wheel a predetermined number of times before the player must spin the wheel.

The above example illustrated in FIGS. 6A to 6K shows how causing the gaming device to select a new award wheel increases the level of player excitement and enjoyment. In this example, the last award wheel selected by the gaming device, award wheel 102*c*, includes larger awards than previously selected award wheels. Therefore, the player's excitement builds as the player progresses further into the game of the present disclosure because the potential for larger awards also builds.

In another embodiment of the present disclosure (not shown), the gaming device includes an offer and acceptance feature. In this embodiment, the gaming device includes a plurality of paytables, each of the paytables associated with an average expected payback. The gaming device initially employs a predetermined one of paytables. The gaming device displays or makes displayable the employed paytable to the player. The gaming device enables the player to accept or reject the employed paytable. If the player accepts the employed paytable, the gaming device determines a game outcome based on that paytable and provides the player with the determined game outcome. If the player rejects the employed paytable, the gaming device randomly selects another paytable and determines a game outcome based on the randomly selected paytable. In one embodiment, the player rejects the paytable by placing a wager. In another embodiment, the gaming device provides a limited number of opportunities to accept or reject the paytable.

In another embodiment of the present disclosure (not shown), the gaming device includes a selection game. The gaming device provides a selection set which includes a plurality of selections. Each of the selections is individually associated with one of a plurality of paytables. The gaming device enables the player to pick a selection to obtain the paytable associated with that selection. If the player chooses to change the selected paytable, the gaming device enables the player to pick another one of the selections, upon a triggering event. In one embodiment, the triggering event is a wager placed by the player. If the player does not choose to change the selected paytable, the gaming device determines an outcome based on the selected paytable and provides the determined outcome to the player. In one embodiment, the gaming device provides the player with a limited number of opportunities to obtain another paytable by picking another selection from the set of selections. The number of opportunities provided to the player may be predetermined, randomly determined, determined based on the player's wager, determined based on the player's status (via a player tracking system), determined based on a triggering event, determined based on time, or determined in any other suitable manner.

It should be appreciated that the present disclosure could be employed in other games such as poker, blackjack, keno and other primary or secondary games.

While the present disclosure is described in connection with what is presently considered to be the most practical and preferred embodiments, it should be appreciated that the present disclosure is not limited to the disclosed embodiments, and is intended to cover various modifications and equivalent arrangements included within the spirit and scope of the claims. Modifications and variations in the present disclosure may be made without departing from the novel aspects of the invention as defined in the claims, and this application is limited only by the scope of the claims.

The invention is claimed as follows:

1. A gaming device operable under control of a processor, said gaming device comprising:

a primary game controlled by the processor;

a secondary game controlled by the processor;

a predetermined first paytable associated with the secondary game, the first paytable having an average expected payback;

a plurality of second different paytables associated with the secondary game, each of said second paytables having an average expected payback;

an input device in communication with the processor; and a display device in communication with the processor and operable to display the game;

wherein the processor is configured with the display device and the input device to control a play of the primary and secondary games by:

(a) enabling a player to input one of:

(i) a first wager amount to cause a play of the primary game, and (ii) a second wager amount to cause a play of the primary game, said second wager amount being different than said first wager amount, (b) if the player inputs the first wager amount and not the second wager amount:

(i) determining an outcome for the secondary game based on the first paytable, and (ii) providing to the player the determined outcome based on the active first paytable, and (c) if the player inputs the second wager amount:

(i) randomly selecting one of the second paytables, (ii) determining an outcome for the secondary game based on the selected second paytable, and (iii) providing to the player the determined outcome based on the selected second paytable.

2. The gaming device of claim 1, wherein the second wager amount is greater than the first wager amount.

3. The gaming device of claim 1, wherein the second wager amount includes the first wager amount.

4. The gaming device of claim 1, wherein at least two of the second paytables have a different average expected payback.

5. The gaming device of claim 1, wherein the average expected payback of the first paytable is different from the average expected payback of at least one of the second paytables.

6. The gaming device of claim 1, wherein the average expected payback of the first paytable is different from the average expected payback of each of the second paytables.

7. The gaming device of claim 1, wherein the average expected payback of the first paytable is the same as the average expected payback of at least one of the second paytables.

8. The gaming device of claim 1, wherein the average expected payback of the first paytable is the same as the average expected payback of each of the second paytables.

9. The gaming device of claim 1, wherein a plurality of the second paytables have the same average expected payback as the first paytable and different volatility than the first paytable.

10. The gaming device of claim 1, wherein a plurality of the second paytables have the same average expected payback as the first paytable and the same volatility as the first paytable.

11. The gaming device of claim 1, wherein a plurality of the second paytables have a different average expected payback than the first paytable and the same volatility as the first paytable.

12. The gaming device of claim 1, wherein a plurality of the second paytables have a different average expected payback than the first paytable and a different volatility than the first paytable.

13. A method of operating a gaming device, said method comprising:

(a) providing a primary game;

(b) providing a secondary game having a predetermined first paytable, said first paytable having an average expected payback, and a plurality of second different paytables, each of said second paytables having an average expected payback;

(c) enabling a player to input one of:

(i) a first wager amount to cause a play of the primary game, and (ii) a second wager amount to cause a play of the primary game, said second wager amount being different than said first wager amount;

(d) if the player inputs the first wager amount and not the second wager amount:

(i) determining an outcome for the secondary game based on the first paytable, and (ii) providing to the player the determined outcome based on the active first paytable; and (e) if the player inputs the second wager amount:

(i) randomly selecting one of the second paytables, (ii) determining an outcome for the secondary game based on the selected second paytable, and (iii) providing to the player the determined outcome based on the selected second paytable.

14. The method of claim 13, wherein the second wager amount is greater than the first wager amount.

15. The method of claim 13, wherein the second wager amount includes the first wager amount.

16. The method of claim 13, wherein the steps (a) to (e) are provided to the player through a data network.

17. The method of claim 16, wherein the data network is an internet.

* * * * *

UNITED STATES PATENT AND TRADEMARK OFFICE

CERTIFICATE OF CORRECTION

PATENT NO. : 8,262,460 B2
APPLICATION NO. : 13/181181
DATED : September 11, 2012
INVENTOR(S) : Harold E. Mattice et al.

It is certified that error appears in the above-identified patent and that said Letters Patent is hereby corrected as shown below:

IN THE CLAIMS:

In Claim 9, Column 30, Line 13, between “and” and “different” insert --a--.

Signed and Sealed this
Eighteenth Day of December, 2012

David J. Kappos

David J. Kappos
*Director of the United States Patent and Trademark Office*